US007921752B2

(12) United States Patent
Poehlmann

(10) Patent No.: US 7,921,752 B2
(45) Date of Patent: Apr. 12, 2011

(54) ENHANCED MULTI-FUNCTION HAND TOOL

(75) Inventor: Paul W. Poehlmann, Quadra Island (CA)

(73) Assignee: Leatherman Tool Group, Inc., Portland, OR (US)

( * ) Notice: Subject to any disclaimer, the term of this patent is extended or adjusted under 35 U.S.C. 154(b) by 2 days.

(21) Appl. No.: 12/077,782

(22) Filed: Mar. 21, 2008

(65) Prior Publication Data

US 2008/0201861 A1 Aug. 28, 2008

Related U.S. Application Data

(62) Division of application No. 11/192,233, filed on Jul. 27, 2005, now Pat. No. 7,353,736.

(51) Int. Cl.

| | |
|---|---|
| ***B25B 7/04*** | (2006.01) |
| ***B25B 11/00*** | (2006.01) |
| ***B25B 7/06*** | (2006.01) |
| ***B25B 7/22*** | (2006.01) |

(52) U.S. Cl. ..... 81/427.5; 81/385; 81/387; 81/405; 7/128; 30/161

(58) Field of Classification Search ..... 81/427.5, 81/385, 387, 393, 405, 177.1; 7/118, 168, 7/125–137; 30/160, 161

See application file for complete search history.

(56) References Cited

U.S. PATENT DOCUMENTS

| | | | |
|---|---|---|---|
| 70,718 | A | 11/1867 | Hoe |
| 79,191 | A | 6/1868 | Bergner |
| 148,488 | A | 3/1874 | Mosher |
| 159,134 | A | 1/1875 | Woodward |
| 187,483 | A | 2/1877 | Rightor |
| 188,777 | A | 3/1877 | Chester |
| 205,108 | A | 6/1878 | Locke |
| 237,138 | A | 2/1881 | Slayton |
| 239,208 | A | 3/1881 | Whitmore |
| 310,439 | A | 1/1885 | Kamak |

(Continued)

FOREIGN PATENT DOCUMENTS

| | | |
|---|---|---|
| DE | 29556 | 4/1884 |

(Continued)

OTHER PUBLICATIONS

W.R. Case & Sons Cutlery, Co., xxChanger, Exchangeable Blade Knife, photocopy of Owner's Manuel, 1987, two pages.

(Continued)

*Primary Examiner* — Bryan R Muller

(74) *Attorney, Agent, or Firm* — Chernoff, Vilhauer, McClung & Stenzel, LLP

(57) ABSTRACT

A multi-function hand tool with a pivotally collapsible jaw-type tool that has a jaw lock which mechanically prevents the jaw-type tool from collapse. The jaw lock mechanism is contained within the jaw pivot joint of the jaw-type tool, and may be partially extended as a push button to prevent unwanted handle collapse. A plurality of blades are pivotally attached to the opposite end of the multi-function tool, which has a blade locking mechanism wherein the blade lock is pivoted about an axis located distal to the blade fastener/pivot axis. Each handle of the multi-function tool may be made of two individual handle halves that unite to form the handle, but that provide very precise tensioning, or the handles may be of a single channel shape using an infinitely adjustable threaded fastener and sleeve to provide precise adjustment of the multiple blades.

18 Claims, 12 Drawing Sheets

U.S. PATENT DOCUMENTS

| | | | |
|---|---|---|---|
| 345,296 | A | 7/1886 | Friebertshauser |
| 358,312 | A | 2/1887 | Weck |
| 403,550 | A | 5/1889 | Wingenroth |
| 405,642 | A | 6/1889 | Woodle |
| 406,524 | A | 7/1889 | Jennings |
| 445,509 | A | 1/1891 | Thayer |
| 458,664 | A | 9/1891 | Scholz |
| 459,409 | A | 9/1891 | Maltby |
| 464,405 | A | 12/1891 | Widmann |
| 471,562 | A | 3/1892 | Minnerly |
| 486,560 | A | 11/1892 | Dinkel |
| 515,828 | A | 3/1894 | Hayden |
| 516,389 | A | 3/1894 | Crutsinger |
| 533,504 | A | 2/1895 | Sonnesen |
| 542,601 | A | 7/1895 | Baker |
| 569,284 | A | 10/1896 | Jacks |
| 580,235 | A | 4/1897 | Strum |
| 592,766 | A | 11/1897 | Effinger et al. |
| 595,909 | A | 12/1897 | Evertz |
| 614,167 | A | 11/1898 | Gardella |
| 653,807 | A | 7/1900 | Hofstetter |
| 660,288 | A | 10/1900 | Broadbooks |
| 673,153 | A | 4/1901 | Baseler |
| 696,995 | A | 4/1902 | Moser |
| 716,623 | A | 12/1902 | Brouillette |
| 799,617 | A | 9/1905 | Steffa |
| 809,579 | A | 1/1906 | Pastore |
| 835,791 | A | 11/1906 | Kelly |
| 858,003 | A | 6/1907 | Klever |
| 867,514 | A | 10/1907 | King |
| 887,494 | A | 5/1908 | Mulertz |
| 896,746 | A | 8/1908 | McCarty |
| 924,796 | A | 6/1909 | Klever |
| 947,823 | A | 2/1910 | Kinney |
| 949,231 | A | 2/1910 | Libby |
| 969,909 | A | 9/1910 | Schrade |
| 1,046,361 | A | 12/1912 | Wulff |
| 1,052,878 | A | 2/1913 | Atkeson |
| 1,179,111 | A | 4/1916 | Knowlton |
| 1,196,278 | A | 8/1916 | Poole |
| 1,242,645 | A | 10/1917 | Bockstahler |
| 1,268,558 | A | 6/1918 | Faix |
| 1,287,637 | A | 12/1918 | Cobb |
| 1,361,021 | A | 12/1920 | Copeman |
| 1,362,142 | A | 12/1920 | Rohrer |
| 1,362,143 | A | 12/1920 | Rohrer |
| 1,370,906 | A | 3/1921 | Newton |
| 1,372,579 | A | 3/1921 | Weishaupt |
| 1,426,214 | A | 8/1922 | Rausse |
| 1,467,661 | A | 9/1923 | Undy |
| 1,472,826 | A | 11/1923 | Champlin |
| 1,486,725 | A | 3/1924 | Brown |
| 1,634,848 | A | 7/1927 | Parrakis |
| 1,635,649 | A | 7/1927 | Tillmanns |
| 1,666,253 | A | 4/1928 | Blincoe |
| 1,828,121 | A | 10/1931 | Adam et al. |
| 1,935,812 | A | 11/1933 | Moody |
| 1,944,116 | A | 1/1934 | Stratman |
| 2,158,728 | A | 5/1939 | Peters |
| 2,197,136 | A | 4/1940 | Share et al. |
| 2,201,918 | A | 5/1940 | Peterson |
| 2,295,385 | A | 9/1942 | Connors |
| 2,310,959 | A | 2/1943 | James |
| 2,391,732 | A | 12/1945 | Mirando |
| 2,392,118 | A | 1/1946 | Cacarillo |
| 2,407,237 | A | 9/1946 | Keiser, Jr. |
| 2,407,897 | A | 9/1946 | Newman |
| 2,439,071 | A | 4/1948 | Basham |
| 2,504,447 | A | 4/1950 | Polincovsky |
| 2,512,862 | A | 6/1950 | Ingwer |
| 2,514,130 | A | 7/1950 | Jones |
| 2,524,653 | A | 10/1950 | Dalley |
| 2,561,682 | A | 7/1951 | Barnett |
| 2,575,652 | A | 11/1951 | Bovee |
| 2,597,540 | A | 5/1952 | Smith |
| 2,601,766 | A | 7/1952 | Riddell et al. |
| 2,650,423 | A | 9/1953 | Phillips |
| 2,662,286 | A | 12/1953 | Yeomans |
| 2,674,796 | A | 4/1954 | Herold |
| 2,721,386 | A | 10/1955 | Habart |
| 2,821,018 | A | 1/1958 | Schwieso |
| 2,847,889 | A | 8/1958 | Cain |
| 2,938,266 | A | 5/1960 | Klein, Jr. |
| 2,952,912 | A | 9/1960 | Crawford |
| 3,100,343 | A | 8/1963 | Wessel |
| 3,196,540 | A | 7/1965 | Porzky |
| 3,357,287 | A | 12/1967 | Wertepny, Sr. |
| 3,568,315 | A | 3/1971 | Smith |
| 3,572,192 | A | 3/1971 | Juras |
| 3,585,704 | A | 6/1971 | Schroeder |
| 3,775,846 | A | 12/1973 | Johnson |
| 3,825,961 | A | 7/1974 | Klein |
| 3,834,022 | A | 9/1974 | Students |
| 3,851,389 | A | 12/1974 | Swanson |
| 3,869,793 | A | 3/1975 | Ferguson |
| 4,040,181 | A | 8/1977 | Johnson |
| 4,073,057 | A | 2/1978 | Gilbert |
| 4,079,513 | A | 3/1978 | Harrison |
| 4,094,064 | A | 6/1978 | Nishikawa et al. |
| 4,099,326 | A | 7/1978 | Mori et al. |
| 4,114,268 | A | 9/1978 | Hildebrandt et al. |
| 4,117,592 | A | 10/1978 | Mori et al. |
| 4,124,939 | A | 11/1978 | Onoue |
| 4,169,312 | A | 10/1979 | Mar |
| 4,203,208 | A | 5/1980 | Tausenfreundt et al. |
| 4,233,737 | A | 11/1980 | Poehlmann |
| 4,238,862 | A | 12/1980 | Leatherman |
| 4,261,103 | A | 4/1981 | Heck |
| 4,283,854 | A | 8/1981 | Austin |
| 4,297,756 | A | 11/1981 | Lance |
| 4,302,877 | A | 12/1981 | Hart et al. |
| 4,347,665 | A | 9/1982 | Glesser |
| 4,391,043 | A | 7/1983 | Sizemore et al. |
| 4,442,600 | A | 4/1984 | Felix-Dalichow |
| 4,519,278 | A | 5/1985 | Heldt |
| 4,563,833 | A | 1/1986 | Aucoin |
| 4,648,145 | A | 3/1987 | Miceli |
| 4,669,140 | A | 6/1987 | Miceli |
| 4,669,188 | A | 6/1987 | Evrell |
| 4,703,560 | A | 11/1987 | Brooker |
| 4,716,797 | A | 1/1988 | Colvin |
| 4,730,394 | A | 3/1988 | Sonner, Jr. |
| 4,741,106 | A | 5/1988 | Yamagishi |
| 4,744,272 | A * | 5/1988 | Leatherman ..... 81/427.5 |
| 4,874,905 | A | 10/1989 | Schnell et al. |
| 4,888,869 | A | 12/1989 | Leatherman |
| 4,891,882 | A | 1/1990 | Bloom et al. |
| 4,942,637 | A | 7/1990 | Yeang-yai |
| 4,947,552 | A | 8/1990 | Barnes |
| 4,947,553 | A | 8/1990 | Bendickson et al. |
| 4,995,128 | A | 2/1991 | Montgomery et al. |
| 5,014,379 | A | 5/1991 | Hull et al. |
| 5,029,355 | A | 7/1991 | Thai |
| 5,033,140 | A | 7/1991 | Chen et al. |
| 5,044,079 | A | 9/1991 | Gibbs |
| 5,060,379 | A | 10/1991 | Neely |
| 5,062,173 | A | 11/1991 | Collins et al. |
| 5,072,513 | A | 12/1991 | Matsushima |
| 5,095,624 | A | 3/1992 | Ennis |
| 5,142,721 | A | 9/1992 | Sessions et al. |
| 5,159,757 | A | 11/1992 | Weid et al. |
| 5,168,629 | A | 12/1992 | Willard |
| 5,189,794 | A | 3/1993 | Kuo |
| 5,203,084 | A | 4/1993 | Kuo |
| 5,212,844 | A | 5/1993 | Sessions et al. |
| 5,243,762 | A | 9/1993 | Orthey |
| 5,245,721 | A | 9/1993 | Lowe et al. |
| 5,251,353 | A | 10/1993 | Lin |
| 5,263,254 | A | 11/1993 | Orthey |
| 5,267,366 | A | 12/1993 | Frazer |
| 5,272,810 | A | 12/1993 | Orthey |
| 5,280,659 | A | 1/1994 | Park |
| 5,303,475 | A | 4/1994 | Baker |
| 5,309,798 | A | 5/1994 | Markwart et al. |
| 5,317,940 | A | 6/1994 | Shun'ko |
| 5,320,004 | A | 6/1994 | Hsiao |
| 5,327,651 | A | 7/1994 | Favreau |

5,351,586 A 10/1994 Habermehl et al.
5,359,778 A 11/1994 Seber et al.
5,400,451 A 3/1995 Furukawa
5,426,857 A 6/1995 Linden
5,432,968 A 7/1995 Beck
5,442,855 A 8/1995 Jobin
5,461,784 A 10/1995 Baron
5,461,786 A 10/1995 Miller
5,481,949 A 1/1996 Yen
5,483,747 A 1/1996 Thompson et al.
5,485,677 A 1/1996 Seber
5,491,856 A 2/1996 Legg
5,495,673 A 3/1996 Gardineo et al.
D368,634 S 4/1996 Frazer
5,502,895 A 4/1996 Lemaire
5,511,310 A 4/1996 Sessions et al.
5,537,750 A 7/1996 Seber et al.
5,546,662 A 8/1996 Seber et al.
5,581,895 A 12/1996 Jeffcoat
5,586,847 A 12/1996 Mattern, Jr. et al.
5,628,115 A 5/1997 Hebert
5,647,129 A 7/1997 Stamper
5,653,525 A 8/1997 Park
5,664,274 A 9/1997 Collins
5,685,079 A 11/1997 Brothers et al.
5,689,886 A 11/1997 Yeh
5,692,304 A 12/1997 Campbell
5,697,114 A 12/1997 McIntosh et al.
5,711,194 A 1/1998 Anderson et al.
5,735,005 A 4/1998 Wang
5,743,582 A 4/1998 Rivera
5,745,997 A 5/1998 Berg et al.
5,761,815 A 6/1998 Lin
5,765,247 A 6/1998 Seber et al.
5,781,950 A 7/1998 Swinden et al.
5,791,002 A 8/1998 Gardiner et al.
5,799,400 A 9/1998 Glesser
5,809,599 A 9/1998 Frazer
5,809,600 A 9/1998 Cachot
5,822,867 A 10/1998 Sakai
5,826,338 A 10/1998 Chilton et al.
5,857,268 A 1/1999 Park
D407,286 S 3/1999 Seber et al.
5,904,078 A 5/1999 Gustafson et al.
5,918,512 A 7/1999 Habermehl et al.
5,920,935 A 7/1999 Beck
5,927,164 A 7/1999 Anderson et al.
5,930,900 A 8/1999 Chang
5,933,893 A 8/1999 Padden
5,946,752 A 9/1999 Parrish
5,950,314 A 9/1999 Chang
5,960,498 A 10/1999 Nabors et al.
5,978,993 A 11/1999 Rivera
5,979,059 A 11/1999 Leatherman et al.
5,979,959 A 11/1999 Rivera
6,000,080 A 12/1999 Anderson et al.
6,003,180 A 12/1999 Frazer
6,006,385 A 12/1999 Kershaw et al.
6,009,582 A 1/2000 Harrison et al.
6,014,787 A 1/2000 Rivera
6,038,723 A 3/2000 Nabors et al.
6,047,619 A 4/2000 Anderson et al.
6,065,213 A 5/2000 Rivera
6,082,232 A 7/2000 Anderson et al.
6,085,620 A 7/2000 Anderson et al.
6,088,860 A 7/2000 Poehlmann et al.
6,088,861 A 7/2000 Sessions et al.
D429,987 S 8/2000 Hung
6,098,225 A 8/2000 McIntosh et al.
6,108,845 A * 8/2000 Hung et al. ..... 7/128
6,109,148 A 8/2000 Anderson et al.
6,119,560 A 9/2000 Anderson et al.
6,119,561 A 9/2000 Anderson et al.
6,122,829 A 9/2000 McHenry et al.
6,128,805 A 10/2000 Rivera
6,131,222 A 10/2000 Anderson et al.
6,145,144 A 11/2000 Poehlmann et al.
6,145,851 A 11/2000 Heber
6,151,999 A 11/2000 Eklind
6,170,104 B1 1/2001 Seber et al.
6,182,541 B1 2/2001 Anderson et al.
6,216,301 B1 4/2001 Rivera
6,220,127 B1 4/2001 Berg et al.
6,233,769 B1 5/2001 Seber et al.
6,243,901 B1 6/2001 Elsener et al.
6,249,977 B1 6/2001 Knoop
6,256,887 B1 7/2001 Osborne
6,257,106 B1 7/2001 Anderson et al.
6,260,453 B1 7/2001 Anderson et al.
6,276,435 B1 8/2001 Zayat, Jr.
6,282,995 B1 * 9/2001 Lin ..... 81/423
6,282,996 B1 9/2001 Berg et al.
6,282,997 B1 9/2001 Frazer
6,286,397 B1 9/2001 Taggart et al.
6,289,541 B1 9/2001 Anderson et al.
6,289,768 B1 9/2001 Anderson et al.
6,293,018 B1 9/2001 Rivera
6,298,756 B1 10/2001 Anderson et al.
6,301,787 B2 10/2001 Mock
6,305,041 B1 10/2001 Montague et al.
6,318,218 B1 11/2001 Anderson et al.
6,331,087 B1 12/2001 Wang
6,336,272 B1 1/2002 Lee
6,357,068 B1 3/2002 Seber et al.
6,370,778 B1 4/2002 Conable
6,389,625 B1 5/2002 Rivera
6,397,709 B1 6/2002 Wall
6,405,395 B1 6/2002 Poehlmann et al.
6,408,522 B2 6/2002 Rivera
D460,332 S 7/2002 Seber
6,412,130 B1 7/2002 Kershaw et al.
6,418,626 B1 7/2002 Jang
6,430,768 B2 8/2002 McIntosh et al.
6,438,848 B1 8/2002 McHenry et al.
6,446,344 B1 9/2002 Gontar
6,450,071 B2 9/2002 Berg et al.
6,474,202 B2 11/2002 Frazer
6,481,034 B2 11/2002 Elsener et al.
6,484,341 B2 11/2002 Hefti et al.
6,487,740 B2 12/2002 Seber et al.
6,487,941 B1 12/2002 Ping
6,510,767 B1 1/2003 Rivera
6,553,671 B2 * 4/2003 Blanchard ..... 30/161
6,572,222 B2 6/2003 Anderson
6,574,868 B1 6/2003 Overholt
6,578,221 B2 6/2003 Ping
6,578,222 B2 6/2003 Anderson
6,588,040 B2 7/2003 Rivera
6,622,327 B1 9/2003 Rivera
6,622,328 B2 9/2003 Rivera
6,625,832 B2 * 9/2003 Montague et al. ..... 7/128
6,625,888 B2 9/2003 Heck et al.
6,634,105 B2 10/2003 Lindermeir
6,675,484 B2 1/2004 McHenry et al.
6,691,357 B2 2/2004 Rivera
6,763,543 B2 7/2004 Rivera
6,769,331 B2 8/2004 Berg
6,779,212 B2 8/2004 Anderson et al.
6,941,604 B2 9/2005 Ackeret
6,983,505 B2 1/2006 McIntosh et al.
6,990,702 B2 1/2006 Rivera
7,039,974 B2 5/2006 Berg
7,040,022 B2 5/2006 Ping
7,051,627 B2 5/2006 Rivera
7,249,390 B2 7/2007 Yale et al.
7,353,736 B2 4/2008 Poehlmann
7,596,870 B2 10/2009 Klecker et al.
7,676,931 B2 3/2010 Knight et al.
2001/0010100 A1 8/2001 Berg et al.
2001/0016987 A1 8/2001 Chen
2001/0018778 A1 9/2001 Montague et al.
2001/0037705 A1 11/2001 Frazer
2002/0020023 A1 2/2002 Anderson et al.
2002/0029426 A1 3/2002 Seber et al.
2002/0108182 A1 8/2002 Rivera
2002/0124322 A1 9/2002 Montague
2002/0124415 A1 9/2002 Mizutani et al.
2002/0138913 A1 10/2002 Ping

| | | | | |
|---|---|---|---|---|
| 2003/0014868 | A1 | 1/2003 | Cech et al. | |
| 2003/0037644 | A1 | 2/2003 | Rivera | |
| 2003/0062055 | A1 | 4/2003 | Park | |
| 2003/0192128 | A1 | 10/2003 | Rivera | |
| 2003/0196273 | A1 | 10/2003 | Anderson et al. | |
| 2004/0031105 | A1* | 2/2004 | Berg | 7/128 |
| 2004/0040120 | A1 | 3/2004 | Zaidman | |
| 2004/0237207 | A1 | 12/2004 | Rivera | |
| 2004/0255731 | A1 | 12/2004 | Berg et al. | |
| 2005/0044717 | A1* | 3/2005 | Nishihara | 30/161 |
| 2005/0150333 | A1 | 7/2005 | Rivera et al. | |
| 2005/0150334 | A1 | 7/2005 | Knight | |
| 2005/0177954 | A1 | 8/2005 | Smith | |
| 2005/0193498 | A1 | 9/2005 | Klecker et al. | |
| 2005/0268468 | A1 | 12/2005 | Klecker et al. | |
| 2006/0070500 | A1 | 4/2006 | Berg et al. | |
| 2006/0150340 | A1* | 7/2006 | Yale et al. | 7/128 |
| 2006/0277762 | A1 | 12/2006 | Knight et al. | |
| 2007/0022849 | A1 | 2/2007 | Poehlmann | |
| 2007/0157771 | A1 | 7/2007 | Rivera | |
| 2007/0204409 | A1 | 9/2007 | Yale et al. | |
| 2007/0209121 | A1* | 9/2007 | Rivera | 7/128 |
| 2007/0294833 | A1 | 12/2007 | Rivera et al. | |

FOREIGN PATENT DOCUMENTS

| | | |
|---|---|---|
| DE | 30788 | 3/1885 |
| DE | 145784 | 11/1903 |
| DE | 159369 | 3/1905 |
| DE | 179077 | 11/1906 |
| DE | 822507 | 11/1951 |
| DE | 2322229 | 5/1974 |
| EP | 0714736 | 6/1996 |
| EP | 0771622 | 5/1997 |
| EP | 0783937 | 7/1997 |
| EP | 693018 | 1/1998 |
| EP | 0854014 | 7/1998 |
| EP | 0980742 | 2/2000 |
| FR | 409943 | 5/1910 |
| FR | 2306050 | 10/1976 |
| FR | 2531654 | 2/1984 |
| FR | 2760955 | 9/1998 |
| GB | 5375 | 0/1882 |
| GB | 15859 | 0/1904 |
| GB | 21369 | 0/1895 |
| IT | 521555 | 3/1995 |
| JP | 3041991 | 2/1991 |
| WO | WO98/18599 | 5/1998 |
| WO | WO99/37446 | 7/1999 |

OTHER PUBLICATIONS

R.C.E. Magnum Fish Tail Holder, photo packaging and digital photographs of tool, at least as early as 1990, nine pages.

Fox Special Folding Pliers, digital photographs of tool, at least as early as 1990, 12 pages.

XURON Corp., Sports Tools, FF-1 Stainless Steel Fishing Combination Cutter/Plier, photocopy of packaging and tool, at least as early as 1993, three pages.

SOG Speciality Knives, Inc., The Paratool, photocopy of User's Guide, at least as early as 1993, two pages.

Slip 'n Snip Collapsible Scissors, photocopy of tool, at least as early as Nov. 29, 1994, one page.

Aitor Pocket Tool, digital photographs of tool, at least as early as Nov. 29, 1994, eight pages.

INOX France Folding Scissors, digital photographs of tool, at least as early as 1994, two pages.

Folding Scissors with Chain, digital photographs of tool, at least as early as 1994, four pages.

Leatherman Tool Group, Inc., "The Original Leatherman PST II", photocopy of product information brochure, at least as early as 1995, two pages.

Gerber, Multi-Plier Pocket Tools, photocopy of catalog pages and tool, at least as early as 1995, three pages.

Wenger of Switzerland, Wengergrip Series, photocopy of instruction sheet, at least as early as Nov. 1996, one page.

Fiskars, Inc., Multi-Snip Tool Kit, photocopy of instruction sheet and digital photos of tool, at least as early as Aug. 1996, ten pages.

BEAR MBC, MGC Cutlery Product Catalog, photocopy of catalog, at least as early as 1996, 20 pages.

Kershaw Knives, Multi-Tool Model A100, photocopy of pages from catalog and instruction sheet, at least as early as Jan. 1998, five pages.

Gerber, Folding Multipurpose Tool with Holder for Replaceable Saw Blade, digital photographs of tool, at least as early as Aug. 1999, four pages.

Gerber, Multipurpose Folding Tool Model MPT 5, digital photographs of tool, at least as early as 1998, two pages.

Kershaw Knives, Kershaw Knives 1999-2000 Product Catalog, photocopy of catalog, at least as early as Jan. 1999, 24 pages.

Buck Knives, Bucklite Multipurpose Folding Tool Model 355, digital photographs of tool, at least as early as May 1999, three pages.

SOG Specialty Knives, Inc., PowerLock® Multipurpose Tool, photocopies of user's guide, at least as early as May 1999, three pages.

E-Bay Advertisement, "Early 1900's Folding Fisherman's Tool MT," Item No. 2153119094, photocopy of print out from web-site, at least as early as Jan. 13, 2003, six pages.

The Surecut Clipper Co., A Division of McQuire Industries, The Pocket Gardener, photocopies of digital photos taken of tool and packaging, at least as early as Jan. 2003, 13 pages.

Remington Arms Co., Bird Hunters Tool, photocopies of digital photos take of tool and packaging, at least as early as Jan. 2003, six pages.

The Rumford Gardener, 8 in 1 Gardener Tool, digital photos of tool and packaging, at least as early as Aug. 2003, eight pages.

Gerber, Multi-Lock Multi-Plier Tool Kit, photocopy of packaging, instructions sheet and digital photos of tool, at least as early as Jan. 2004, eight pages.

Gerber, Legendary Blades Tool with Replaceable Saw Blade Coupler, photocopy of instruction sheet and digital photos of tool, at least as early as Aug. 2004, eight pages.

Kershaw Knives, Kershaw Blade Traders Camp Tool, photocopy of instruction sheet and digital photos of tool, at least as early as Aug. 2004, nine pages.

Gerber, Freeman Exchange-a-Blade, photocopy of instruction sheet and digital photos of tool, at least as early as Aug. 2004, four pages.

* cited by examiner

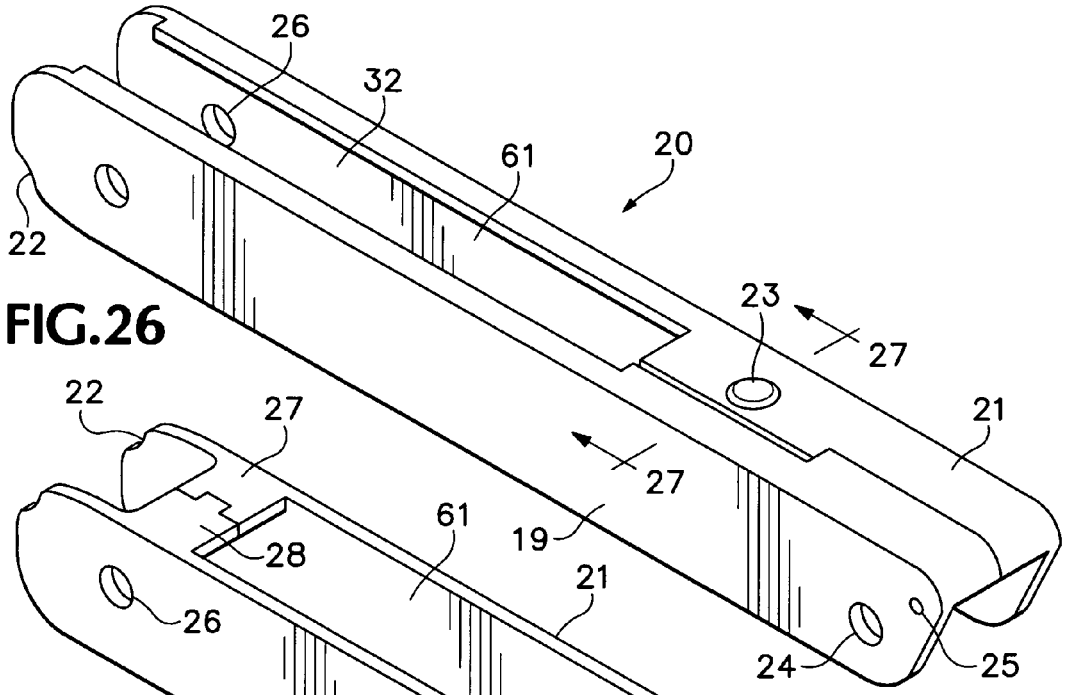
FIG.26
FIG.28
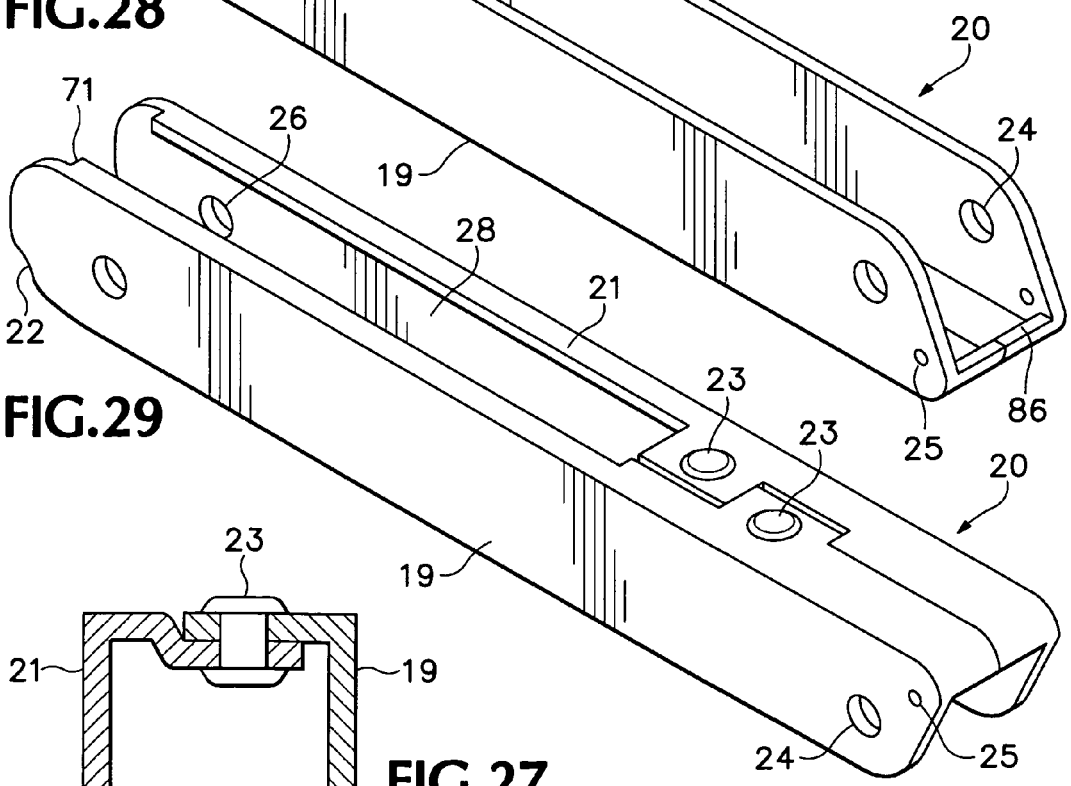
FIG.29
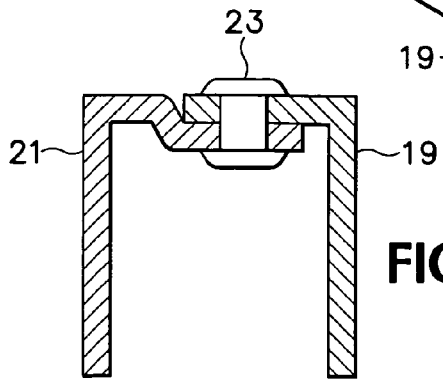
FIG.27

ENHANCED MULTI-FUNCTION HAND TOOL

CROSS REFERENCE TO RELATED APPLICATIONS

This is a division of U.S. patent application Ser. No. 11/192,233, filed Jul. 27, 2005, now U.S. Pat. No. 7,353,736.

TECHNICAL FIELD OF THE INVENTION

The present invention relates generally to mechanical hand held tools, and more specifically to multi-function pocket tools which include a jaw-type tool and other selected tools.

BACKGROUND OF THE INVENTION

Multi-function tools are well known in the art, and typically are designed around a jaw-type tool such as gripping tools (pliers and the like) or cutting tools (scissors, shears, pruning tools, etc). These jaw-type tools may or may not be folded or retracted into the handles of the tool, but utilize both handles for operation. And, a seemingly endless list of additional tools such as screw drivers, knife blades, can openers, cork screws, files, awls, etc. are then designed to be incorporated into the handles so that a wide variety of useful tools can be combined into one compact multi-function tool. It should be noted that "blades" and "tools" may be used interchangeably throughout this disclosure, to refer generally to any of the tools listed above that are attached to only one of the handles, and may include a pair of scissors or other hinged tools that can be extracted out of one handle.

Multi-function tools in which the jaw-type tool does not retract or fold into the handles have a significant disadvantage in the size of the overall tool. In order to comfortably use the tool, and be able to apply any reasonable gripping force in the case of pliers and the like, the handles must be long enough to be gripped by the hand. This makes a non-retractable, non-folding tool too long to fit in a pocket, and uncomfortably long to fit in a sheath and be worn on a belt around the waist of the user. Additionally, in the case of cutting tools (scissors, pruning tools, shears, etc), the sharp edges are also exposed and can inadvertently snag or cut people, clothing, etc., perhaps even without the knowledge of the person carrying the tool.

Multi-function tools that retract the jaw-type tool into the handles, as disclosed in U.S. Pat. No. 5,142,721 of Sessions, et al. overcome the tool length issue described in that when the jaw-type tool is retracted the multi-function tool is short enough to be carried comfortably in a pocket or in a sheath, and offers the user and his surroundings protection from sharp surfaces if the jaw-type tool is designed for cutting. This design of tool has significant limitations as well, however. Some of the noted disadvantages include complexity in construction of the tool, somewhat reduced strength of the jaw-type tool (particularly important in gripping tools such as pliers), and a very confined area for extracting other tools out from the cavities within the handles due to the fact that the handles only open a few degrees about their dependent hinged attachment to the tang end of the jaw-type tool. Finally, this type of tool typically maintains a gap between the two handles when the jaw-type tool is retracted into the handle and all other tools are stored within their respective cavities. This is disadvantageous for storage in a pocket, as it becomes a "trap" for loose change, keys, lint, and any other items that may be simultaneously stored in the pocket, so that when the tool is retrieved from the pocket these items are also removed, and can fall from the tool and potentially be lost.

Multi-function tools that fold the jaw-type tool into the handles for storage as disclosed in U.S. Pat. No. 5,743,582 of Rivera overcome the problems associated with both other types of tools previously described, but present a different limitation in that when the jaw-type tool is extended, the handles cannot open the jaw-type tool if any significant force is exerted on the outside of the jaws, as the handles of the tool will start to collapse for storage. This is not particularly significant for cutting tools, but may be a constraint for gripping tools if they are to be used for expanding springs and the like.

One limitation that may be associated with any of these three types of tools is that each of the handles is typically manufactured from a single piece of metal, and is formed generally into a channel shape. And, although this can add structural strength, it becomes significantly more difficult to manufacture the tools with little or no lateral clearance or sideways "play" so that an extended blade or tool is held firmly when encountering forces that act perpendicular to the longitudinal plane, i.e. acting against the side of tool, because of the one-piece construction. The walls of the handle cannot be brought closer together to take up any clearance or "play" without bending the channel itself. Any excess clearance also affects the feel of the tool, potentially giving the user a less than optimal confidence in the tool. Consequently, the thickness of the tools and any interspersed spacers must be precise both individually and cumulatively so as to precisely fill the space between the channel walls.

Another limitation generally associated with any of these types of tools, and with folding knives in general, resides in the blade lock mechanism. Known locking mechanisms used to lock tools in the fully extended position, of which there are many designs, always have a substantial amount of material and numerous parts (lock, spring, and connecting parts) located within the typical storage cavity of the tool handle. In other words, most or all of the blade lock mechanism is contained between the two pivot pins located at the two opposite ends of the tool handle, and generally between the outer side walls of the tool handle. This increases the overall size of the tool, which is undesirable.

It is also desired to avoid clumping, the phenomenon of when one blade is selected for extension, the other tools nearby rotate with the selected tool due to frictional forces holding the tools and interspersed spacers together within the channel of the handle.

Accordingly, there is a need in the art for a multi-function tool that can take advantage of the benefits of the folding type tool, but which can also overcome the noted limitations associated with opening the jaws of previously available tools under force. A need also exists for a handle that provides a greater dimensional tolerance range of the tools in a multi-function tool yet still provides a solid feeling tool that minimizes the amount of lateral "play" associated with the tool, and that facilitates optimal ways of assembling such a tool. A need for removing most or all of the blade locking mechanism from between the two pivot pins of a tool handle yet still providing a secure blade lock mechanism also exists. It is to these ends that the folding multi-function tool of the present invention is primarily directed.

SUMMARY OF THE INVENTION

The present invention provides a folding multi-function tool which overcomes some of the aforementioned limitations of the prior art, and which includes features that may be used individually or in combination to address those limitations, as desired. A multi-function tool that is an exemplary embodiment of one aspect of the present invention includes a pair of jaw handles each pivotally connected to an end of one of the two jaws, scissors blades, or the like, of a jaw-type tool, with the jaws being pivotally connected to each other. The two handles may each have an opening on the outward-facing side so that when the jaw-type tool is extended they can pivot around the two handle pivots where the jaws are attached to the handles, and when pivoted the handles can receive the jaws through the openings so the jaws can then be stored within the cavities. When the jaws are extended, lock mechanisms may be deployed in accordance with one aspect of the invention to prevent the handles from pivoting around the pivot axes of the handle pivots where the jaws are attached, thereby enabling the handles to open the jaws even in the event a force is exerted on the outside of the jaws that would otherwise cause the handles to collapse and pivot around the jaws as for storage.

In one such embodiment, the lock mechanism may be located at the jaw pivot point connecting the two jaws together. The lock mechanism may extend outward radially to close proximity with the handles, and can be engaged or retracted by pushing on a part of the lock mechanism itself.

In another embodiment of this aspect of the tool, a spring could be deployed from a sidewall of each handle upon extending the jaws, and could be released by one or more release buttons when the user is ready to retract the jaws back into the handles.

A multi-function tool including an embodiment of another aspect of the present invention provides for each respective handle utilizing multiple pieces in its construction, the pieces separately including walls of the channel running longitudinally so that the distance between the walls formed by the separate pieces is expandable and retractable to more precisely fit the total thickness of the combined tools and other separating spacers interspersed therebetween. The pivot axes for the tools carried in each handle are any of a variety of types of screw studs that can be appropriately tightened axially to control or eliminate unwanted lateral clearance or "play" and simultaneously secure the multiple parts of the handle.

As yet another aspect of a multi-function tool, a singular or multiple blade lock mechanism may be located on the distal end of each of the two handles of the tool, the end opposite where the jaws are connected to the handles. A substantial portion of the components of the blade lock mechanism are located further toward the distal end of the handle than the hinge or pivot point of a tool located at the distal end of the handle, with the release mechanism optionally being located at or between the two pivots but located on the outside of the handle walls, thereby reducing or eliminating the need for space for the release mechanism in the blade or tool cavity.

In one embodiment, such a blade lock mechanism has a torsion spring located distal to the pivot point or hinge, and may have its own pivot to secure the spring and lock mechanism. In another series of embodiments, a blade spring mechanism may be disposed around this spring pivot (even if the spring and/or lock mechanism are not used) to provide a force on the tang of each tool independently to help prevent so-called clumping when a tool is extended from its storage cavity within the handle.

As previously mentioned, these embodiments of various aspects and details of a multi-function hand tool may stand alone, or be used in any combination thereof, to provide a multi-function tool to meet associated needs. The resulting multi-function tool is then widely adaptable, strong, and user-friendly. The foregoing will become more readily understood upon consideration of the following detailed description, taken in conjunction with the accompanying drawings.

BRIEF DESCRIPTION OF THE DRAWINGS

FIG. 26 is a perspective view of a handle embodying another aspect of the present invention, showing a rivet connection.

FIG. 27 is a sectional view taken along line 26 showing two handle halves riveted together.

FIG. 28 is a perspective view of the handle depicted in FIG. 25, rotated about its longitudinal axis to show a handle brace.

FIG. 29 is a perspective view of a handle embodying overlapping plates interconnected with two rivets.

DETAILED DESCRIPTION OF THE INVENTION

Figure 1:
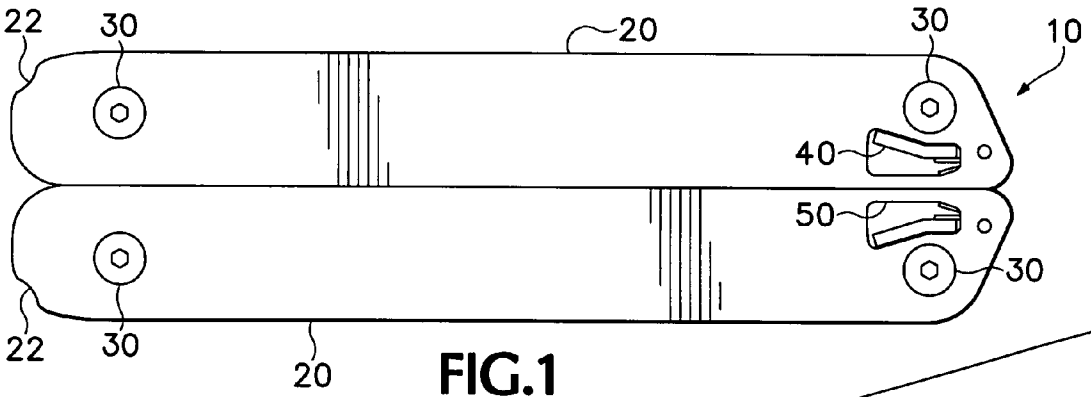
FIG. 1 is a side view of a multipurpose folding tool which is an embodiment of the present invention, in the folded or collapsed position.
Figure 2:
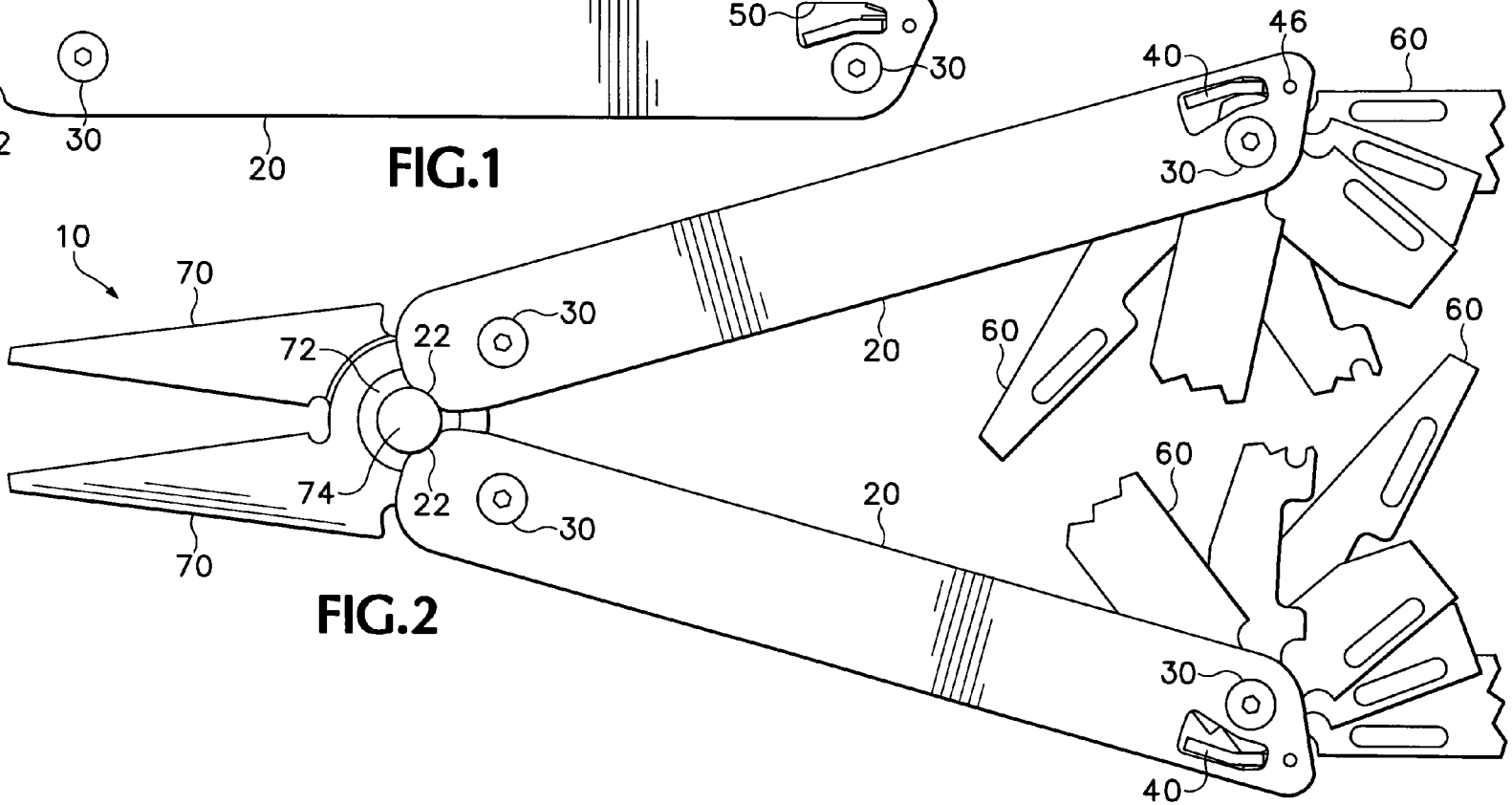
FIG. 2 is an elevational view of the tool shown in FIG. 1 with a pair of jaw-like tools extended from one end of the handles and various other tools partially extended at the other end of each handle.

Referring now to FIGS. 1 and 2 of the drawings, a folding multi-function tool 10 shown folded in FIG. 1 includes a jaw-type tool with jaws 70 being pivotally rotatable around a pivot assembly 72. The jaws 70 may be pliers, scissors, pruners, wire cutters, crimpers, shears, etc, or may even contain combinations, as is known in the art. A jaw lock cylinder 74 is contained within the pivot assembly 72, and will be more fully explained later in this disclosure. The jaws 70 are each connected to one of a pair of handles 20 by respective fasteners 30. The handles 20 each have a jaw lock recess 22 for interaction with the jaw lock cylinder 74. At the other end of the handles 20, one or more tools 60 are secured to the handles 20 by fasteners 30. The tools 60 may include screw drivers, can openers, files, saws, awls, flashlights, scissors, pens, cork screws, etc. in any desired combination. When fully extended, the tools 60 may be secured by a locking mechanism to be disclosed later. A blade lock release arm 40 is used to release the locking mechanism so that the tool 60 may be returned to a storage cavity 61 (seen best in FIG. 28) defined within the handle 20. FIG. 2 provides a representative view of the various tools 60 at least partially extended from the stowed position, and FIG. 1 shows the multi-functional tool 10 with all representative tools in the stowed position.

Figure 3:
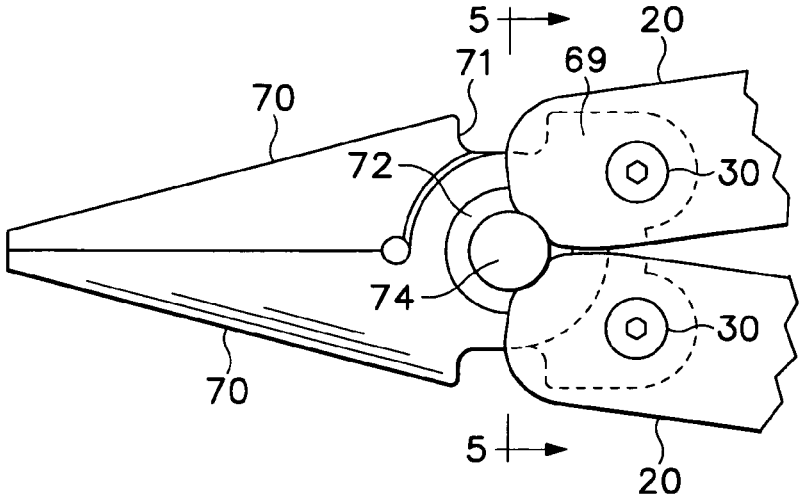
FIG. 3 is a side elevational view of the jaw-type tool and a portion of each of the handles with a locking mechanism engaged to prevent the handles from pivoting or collapsing around the jaw-type tool.
Figure 4:
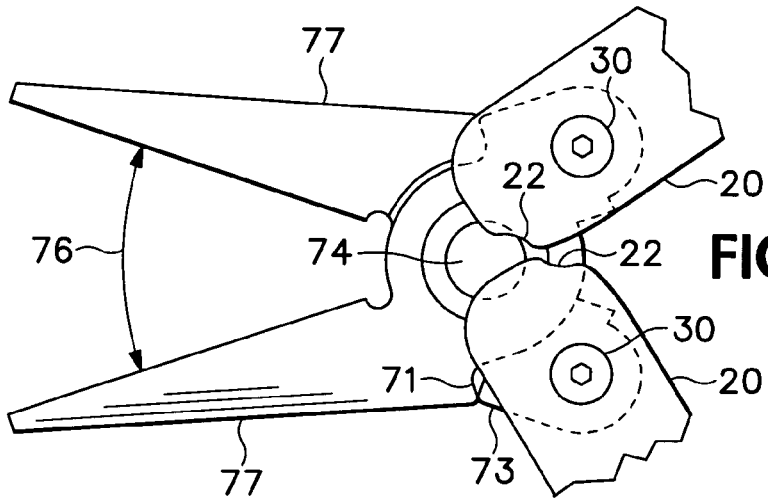
FIG. 4 is a view similar to that of FIG. 3, of the jaw-type tool and a portion of each of the handles with the locking mechanism disengaged to allow the handles to collapse pivotally around the jaw-type tool.
Figure 5B:
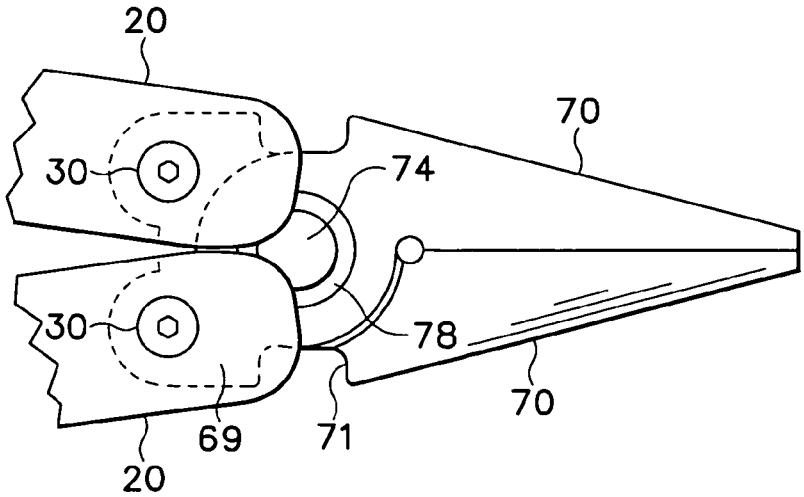
FIG. 5B is a side elevational view of the jaw-type tool and a portion of each of the handles, taken from the side opposite that shown in FIG. 3.
Figure 5:
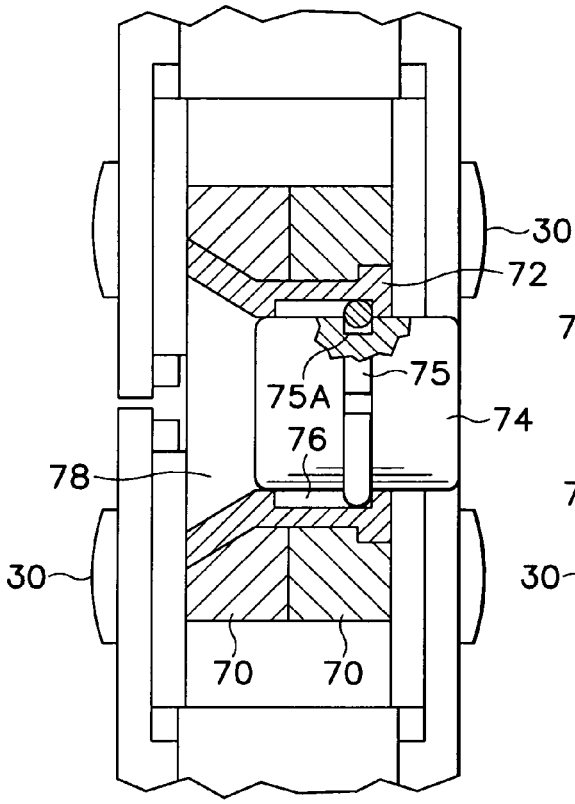
FIG. 5 is a sectional view taken along line 5-5 of FIG. 3, showing the locking mechanism engaged.
Figure 5A:
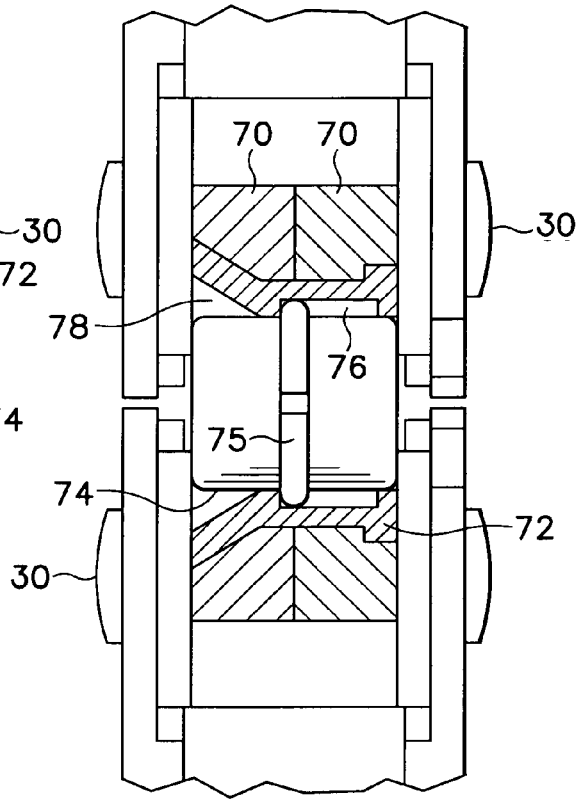
FIG. 5A is a sectional view taken along line 5-5 of FIG. 3, showing the locking mechanism disengaged.

Turning now to FIGS. 3, 4, 5, and 5A, the jaw locking mechanism will now be explained. In FIG. 3, the jaws 70 are extended with respect to the handles 20 and rotated into a closed position about pivot assembly 72, with respect to each other. A jaw lock cylinder 74 is contained within pivot assembly 72, and can be stowed basically within the pivot assembly 72 as shown in FIG. 5A, or may be moved partially out of the pivot assembly 72, as shown in FIG. 5. Each jaw 70 has a jaw mount base portion 69 where it is mounted pivotally to the handle 20 by a fastener 30. Since each jaw 70 is mounted to a handle 20 and the two jaws 70 are pivotably inter-connected at pivot assembly 72, the jaws 70 can be opened and closed by relative movement of the handles 20.

A nominal amount of friction between the handles 20 and the jaw mount base portions 69 keeps the handles from collapsing about the jaw mount base portions 69 during use. This nominal friction force must be overcome when moving the jaws 70 from their opened position as shown in FIGS. 3 and 4 to their stowed position within the handles 20. An opening stop 71 of one jaw 70 interfaces with a mount stop 73 of the other jaw 70 to provide a positive stop for opening the jaws 70, thereby providing a maximum jaw opening angle 76 as shown in FIG. 4. When the jaw lock cylinder 74 is stowed within the pivot assembly 72 (FIG. 5A), efforts to move the handles 20 past the maximum jaw opening angle 76 will overcome the friction force, thereby allowing the handles to collapse as shown in FIG. 4. Similarly, if a sufficient force acts on the outer sides 77 of the jaws 70, and if the handles 20 are then separated, the friction force will be overcome and the jaws 70 will swing around fasteners 30. Completion of this motion will allow the jaws 70 to pass through openings and be stored within the confines of the storage cavities 61 of the handles 20 as shown in FIG. 1.

If, on the other hand, jaw lock cylinder 74 is moved to protrude partially out of the pivot assembly 72 (FIG. 5), it engages itself with the jaw lock recess 22 of each handle 20 and thus prevents the jaws 70 from being collapsed about the fasteners 30. The handles 20 are able to open and close the jaws 70 about the pivot assembly 72, but in the event the friction force is overcome, the jaw lock recess 22 of each handle 20 will contact the jaw lock cylinder 74, which will act as a mechanical stop, thereby preventing the jaws 70 from being collapsed. The jaw lock recess 22 may be shaped to closely match the shape of the jaw lock cylinder 74 as shown in the FIGS, but such a match is not necessary. The jaw lock recess 22 is shown in a cylindrical shape, but may take other shapes as desired, so long as it is capable of preventing the jaws 70 from being collapsed into the handles 20.

As shown in FIGS. 5, 5A and 5B, the jaw lock cylinder 74 is surrounded by and supports a lock cylinder flange 75. The pivot assembly 72 includes a pair of inwardly extending rims that define a flange recess 76 that allows the jaw lock cylinder 74 to slide between the positions shown in FIGS. 5 and 5A, with the inwardly directed rims of the flange recess 76 interacting with the lock cylinder flange 75 to provide positive mechanical stops. A finger access opening 78 is provided where shown in FIGS. 5, 5A and 5B and is exposed on the side of the tool opposite the end of the cylinder 74 shown in FIGS. 3 and 4, so that the user can push the contained lock cylinder 74 partially out of the pivot assembly 72, thereby allowing it to interact with handles 20. The lock cylinder flange 75 may be an annular wire form extending approximately 340 degrees around the lock cylinder 74 and mating into a circumferential groove 75A (see FIG. 5) in the lock cylinder 74. By utilizing a wire form and heat treating as necessary, the wire form can act as a spring providing frictional resistance between the internal wall of the flange recess 76 and the exterior edge of the wire form. By making the wire form somewhat circumferentially shorter than a full circle, it could be compressed into the circumferential groove 75A of the lock cylinder 74, allowing for manufacture and assembly of the lock cylinder 74 into the pivot assembly 72. Alternatively, the lock cylinder flange 75 may be a gasket, a spring, one or more dogs, or other means of providing positive stops. The pressure needed to move the jaw lock cylinder 74 can be as little or as much as desired, and may be controlled by the type of fit between the lock cylinder flange 75 and the flange recess 76, or the jaw lock cylinder 74 or the pivot assembly 72 may contain other spring mechanisms (not shown) to provide resistance. The jaw lock cylinder 74 can be returned to its position within the pivot assembly 72 by pushing it back in. In the embodiment shown, an additional finger access opening is not required because the jaw lock cylinder 74 is easily accessible, but one may be added if desired.

Figure 5C:
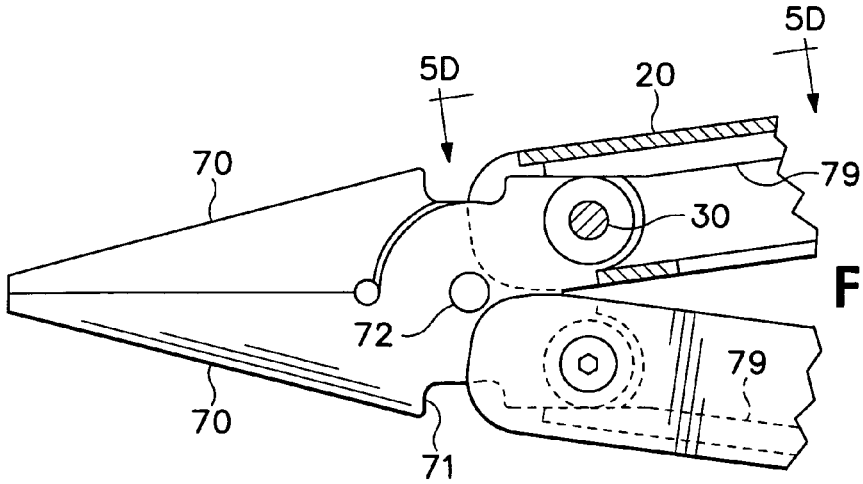
FIG. 5C is a partially cutaway elevational view of the jaw-type tool and a portion of each of the handles with a sidewall locking mechanism engaged to prevent the handles from pivoting or collapsing around the jaw-type tool.
Figure 5D:
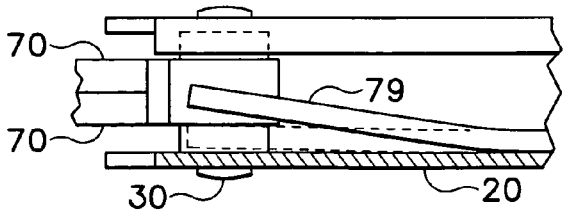
FIG. 5D is sectional view taken along line 5D-5D of FIG. 5C, showing the locking mechanism engaged.

In an alternate embodiment shown in FIGS. 5C and 5D, a sidewall of each handle 20 could contain a leaf spring 79 that extends from the sidewall of the handles 20 toward the base portions 69 of the jaws 70 and into a position along an outer surface of the base portions 69 after the jaws 70 are fully extended from the storage cavity 61. The spring 79 extending from the sidewall of the handle would interface with the opening stop 71 of the jaws 70 when the jaws 70 are fully opened. This spring 79 could replace the function of the mount stop 73 of the jaws 70 shown in FIG. 4, in that the spring 79 then determines the maximum opening angle 76 of the jaws 70, and also acts as a jaw lock, preventing the handles 20 from being folded with respect to the jaws 70. The spring 79 can be pushed back into the handle 20 when the user is ready to collapse the jaws 70 for storage. This type of lock, known as a liner lock, has been heretofore limited to use in locking folding knife blades.

Figure 5E:
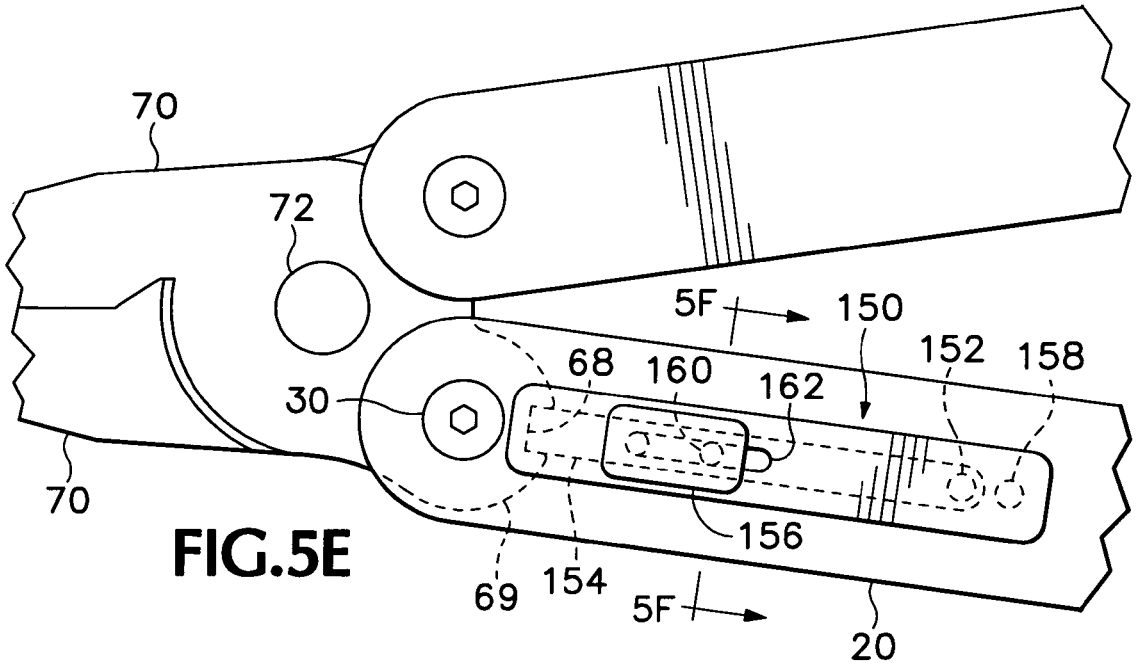
FIG. 5E is a side elevational view of the jaw-type tool and a portion of each of the handles with a sliding sidewall locking mechanism engaged to prevent the handles from pivoting or collapsing around the jaw-type tool.
Figure 5F:
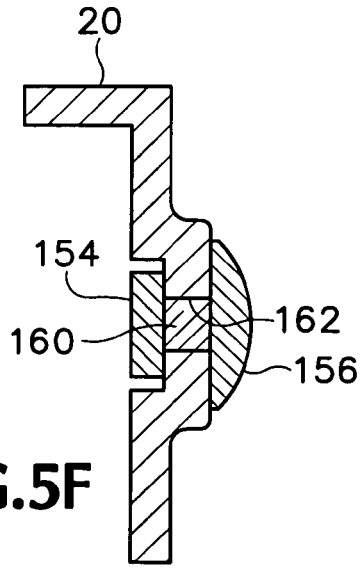
FIG. 5F is a sectional view taken along line 5F-5F of FIG. 5E, showing the interaction of the sliding sidewall locking mechanism with the side of the handle.
Figure 6:
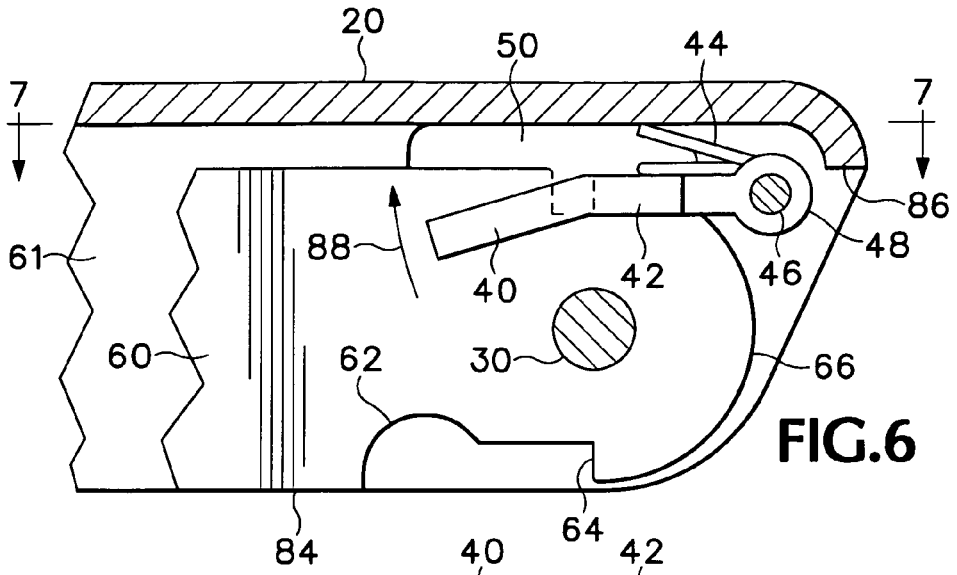
FIG. 6 is a partially cutaway elevational view of a portion of the multipurpose folding tool, including a blade lock mechanism including a torsion spring.

In another alternate embodiment shown in FIGS. 5E and 5F, a sidewall of each handle 20 could contain a sliding sidewall locking mechanism 150. The sliding sidewall locking mechanism contains a sliding rod 154 located on the inner sidewall of handle 20, and capable of being moved longitudinally along the handle wall via a thumb pad 156 mounted onto the sliding rod 154 via one or more mechanical attachments 160. It is requisite that the sidewall of the handle 20 has a slot 162 cut into it for allowing the mechanical attachments 160 room to slide. Each of the base portions 69 of the jaws 70 contains a shaped recess 68 for receiving an end of the sliding rod 154. By urging the end of the sliding rod 154 into the shaped recess 68, the handles 20 are rigidly secured to the jaws 70. When the sliding rod 154 is urged out of, and away from the shaped recess 68, the jaw 70 is then free to rotate about the fastener 30. A protrusion 152 may be placed on the sliding rod 154 to interact with a detent 156 placed on the handle as a means of preventing unwanted sliding of the rod 154.

Figure 7:
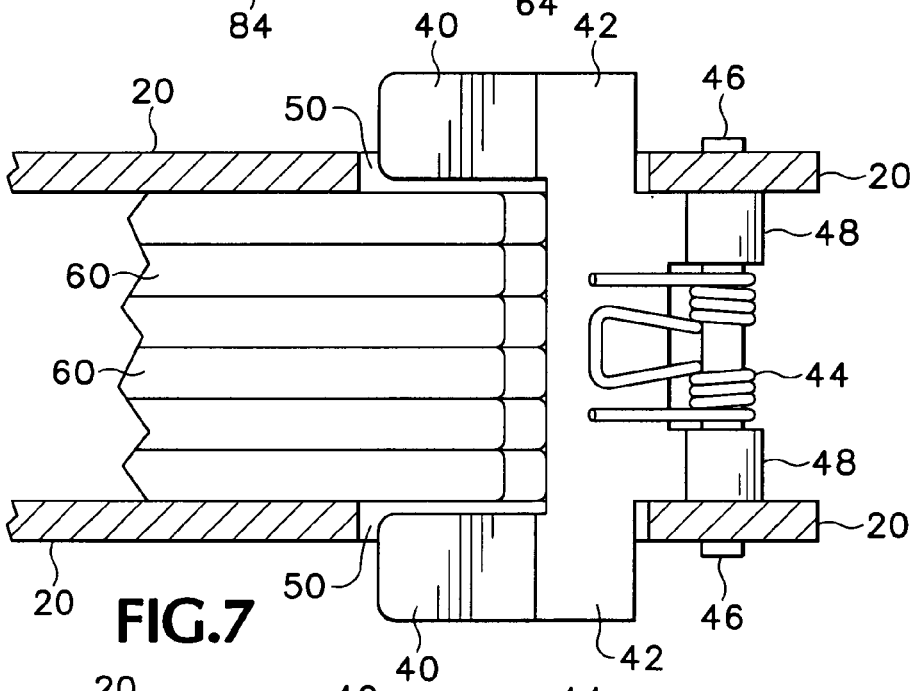
FIG. 7 is a partially cutaway view taken along line 7-7 of FIG. 6 showing the torsion spring more clearly.
Figure 8:
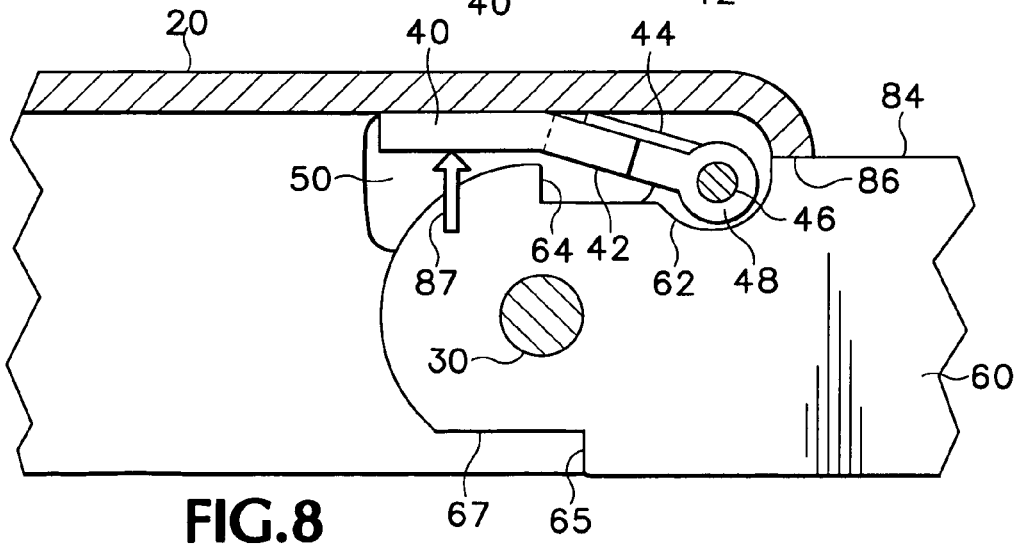
FIG. 8 is an elevational view, similar to that of FIG. 6, showing the blade lock in the disengaged position.
Figure 9:
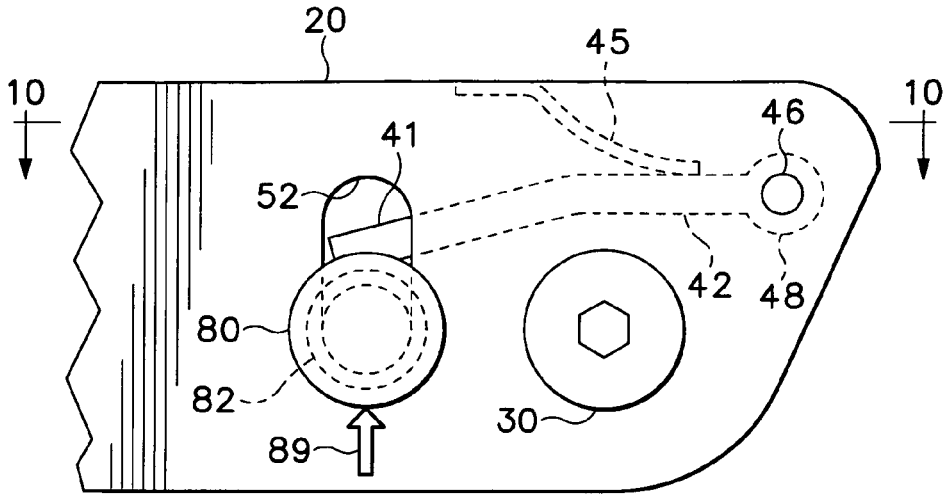
FIG. 9 is a side elevational view of a part of the tool including a blade lock release mechanism which is another embodiment of a blade lock according to the present invention.
Figure 10:
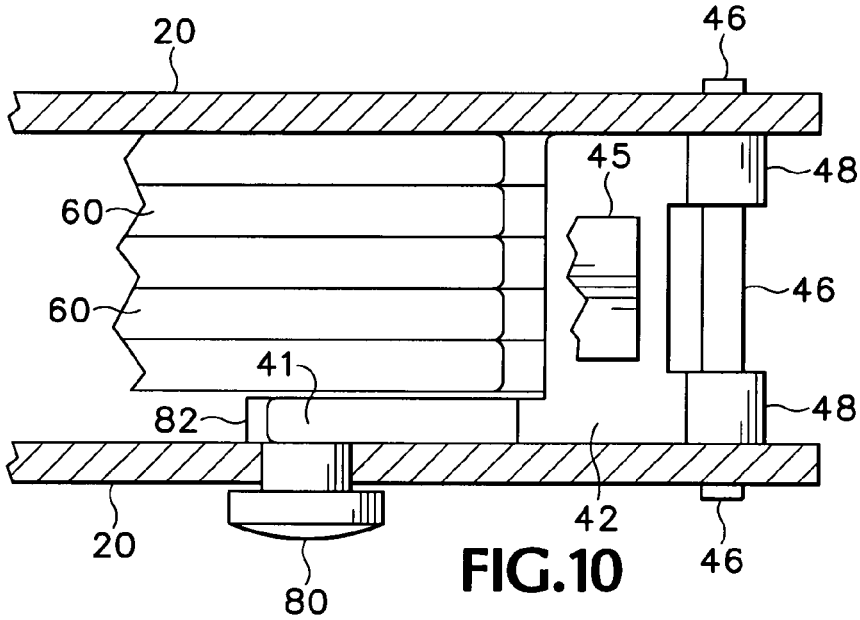
FIG. 10 is a partially cutaway view taken in the direction of line 10-10 of FIG. 9, showing a similar blade lock mechanism including a leaf spring.

Turning now to FIGS. 2 and 6-8, a blade lock release arm 40 extends through a lock release opening 50 in the wall of handle 20. As shown in FIG. 7, the blade lock release arm 40 is accessible from either side of the handle 20, and is attached to locking body 42 of the blade lock. A blade lock pivot pin 46 runs through a lock sleeve 48 and a torsion spring 44, thereby providing rotational force upon the locking body 42 of the blade lock. As shown in FIG. 2, the blade lock pivot pin 46 is located distal to the fasteners 30 and to the blade lock release arm 40. The torsion spring 44 urges the locking body 42 toward the tang of the blade or tool. One or more tools or blades 60 pivot about fastener 30, from a retracted or closed position within the storage cavity 61 in the handle 20 to an extended and locked position. The base or tang portion of the blade 60 contains a blade storage recess 65, a blade hinge recess 62 and a blade lock catch 64. While the blade is in the stowed position within the cavity of the handle 20, the locking body 42 is able to rest in the blade storage recess 65 without touching the blade vertical wall of the blade storage recess 65, but while resting on the horizontal surface 67 on the tang end of the blade. The peripheral surface 66 of the tang end of the blade 60 is curved such that the blade 60 may be rotated out of the cavity in the handle 20 by overcoming the torsional force caused by the blade torsion spring 44 on the horizontal surface 67, and the small amount of friction force between the horizontal surface 67 and the blade locking body 42. When the blade 60 is fully rotated out of the handle 20, the blade hinge recess 62 allows the blade 60 to extend substantially co-linear with the handle 20, without interference from the blade lock pivot pin 46, as shown in FIG. 8., and the locking body 42 is able to engage the perpendicular face of the blade lock catch 64. With the locking body 42 engaged, the blade 60 is held firmly, preventing it from rotating back into the cavity 61 in the handle 20. The blade 60 is prevented from over rotating by the blade stop 86 of the handles 20. To release the blade 60 from the extended position, the operator would rotate the blade lock release arm 40 and thereby move the locking body 42 around the blade lock pivot pin 46, away from the tang end of the blade 60 as indicated by arrow 88 in FIG. 6. A force arrow 87 allows the blade lock to be shown in the release position in FIG. 8, such that the blade 60 could be rotated back to the stored position.

Figure 11:
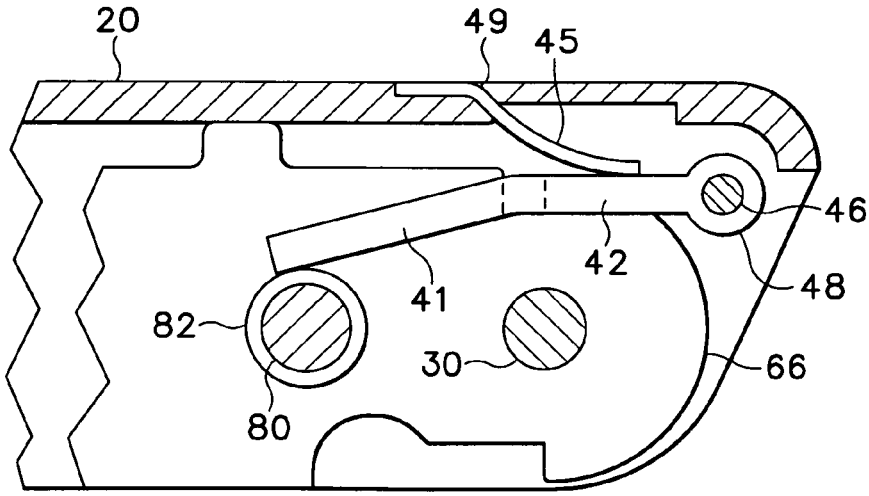
FIG. 11 is a partially cutaway elevational view of the part of the tool shown in FIG. 9, showing the blade lock in the engaged position.
Figure 12:
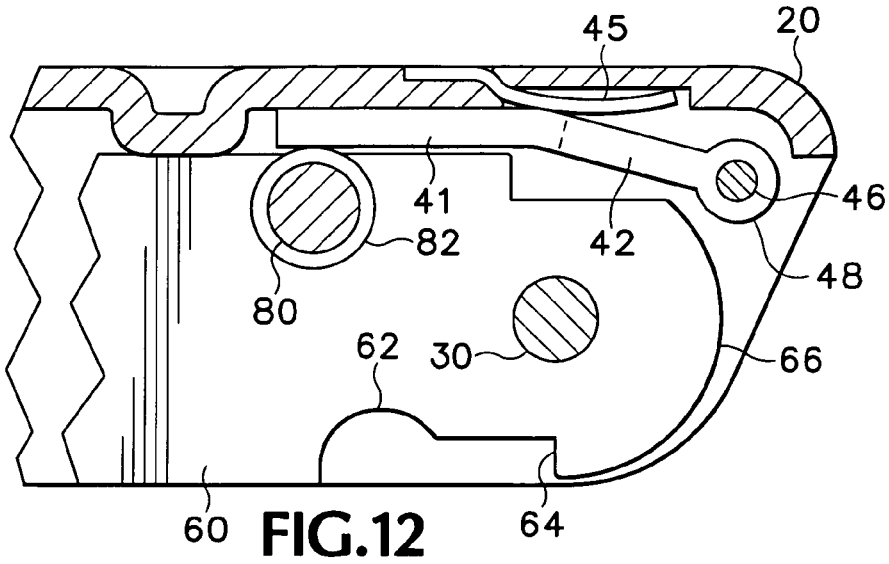
FIG. 12 is a view similar to that of FIG. 11, showing the blade lock in the disengaged position.

Another locking mechanism embodiment, as shown in FIGS. 9-12, utilizes the locking body 42, blade lock pivot pin 46, and lock sleeve 48. A leaf spring 45 provides the resistant force to urge the locking body 42 toward the blade 60. One end of the leaf spring 45 is held securely at an anchor point 49 in handle 20 as best seen in FIG. 11, and the spring 45 extends to contact the locking body 42 to urge it toward the tang of the blade 60. A lock release lever 41 extends from the locking body 42 and runs parallel to the internal surface of the side wall of the handle 20. A release tab 80 is conveniently exposed on the outer side of the side wall of the handle 20 and has a shaft that extends through a lock release opening 52 in the side wall and is attached to a release tab interface 82 such as a collar fitted on the shaft and located inside the cavity of the handle 20, so that the lock release lever 41 extends over the release tab interface 82. The tab release interface 82 is large enough in diameter that it cannot be extracted through the lock release opening 52, and it may be attached to the release tab 80 by any known mechanical means. The release tab 80 and the release tab interface 82 must fit together with sufficient clearance along the shaft that the combination may be moved through the range provided by the lock release opening 52. Release of the locking body 42 is accomplished by sliding the release tab 82 as indicated by the arrow 89 so that the locking body 42 rotates out of engagement with the blade lock catch 64 of the blade 60, at which time the blade may be rotated back to its stowed position in the cavity 61.

Figure 13:
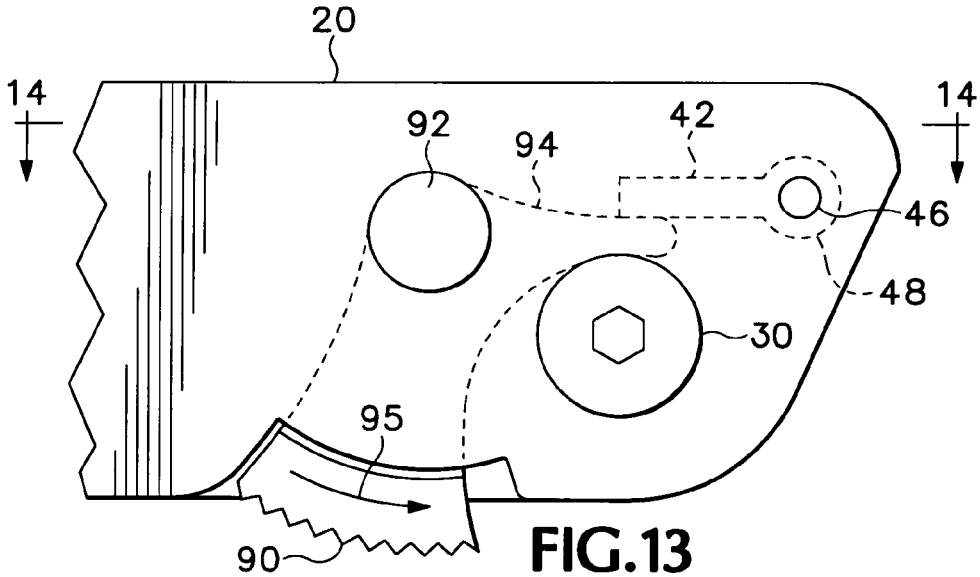
FIG. 13 is a side elevational view of a part of a multipurpose tool including a latch mechanism that is another embodiment of one aspect of the present invention, including a rotational blade lock release mechanism located within the walls of the handle.
Figure 13A:
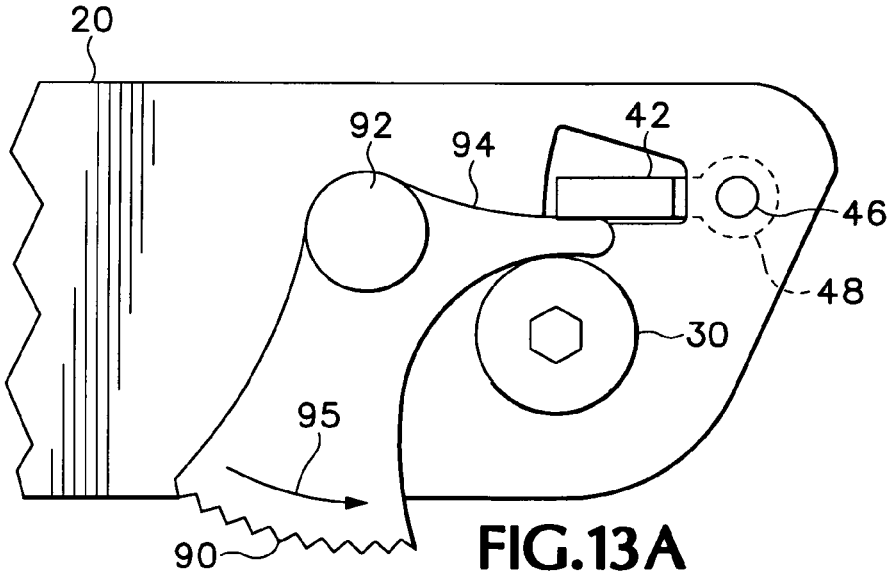
FIG. 13A is a side elevational view similar to that of FIG. 13, showing the rotational blade lock release mechanism located outside the walls of the handle.
Figure 14:
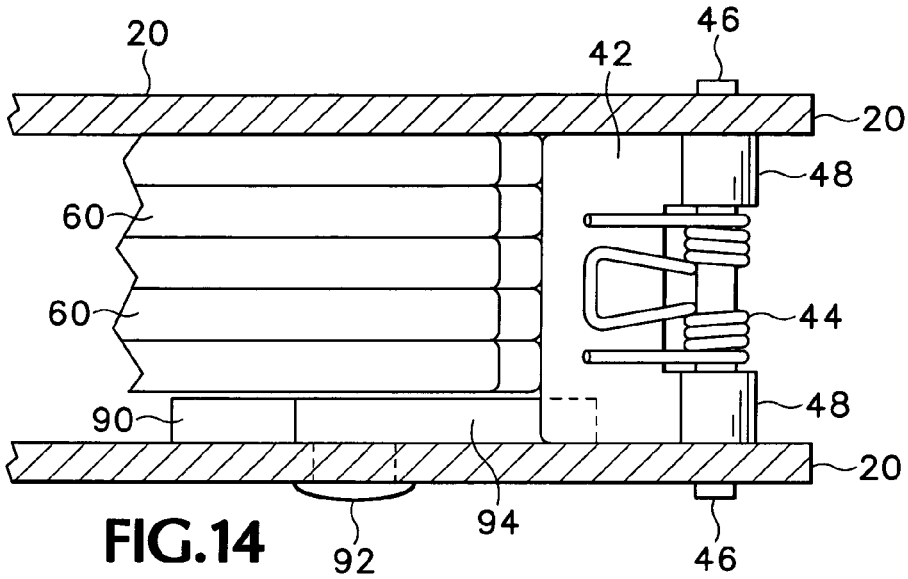
FIG. 14 is a partially cutaway view taken along line 14-14 of FIG. 13, showing the blade lock mechanism.
Figure 15:
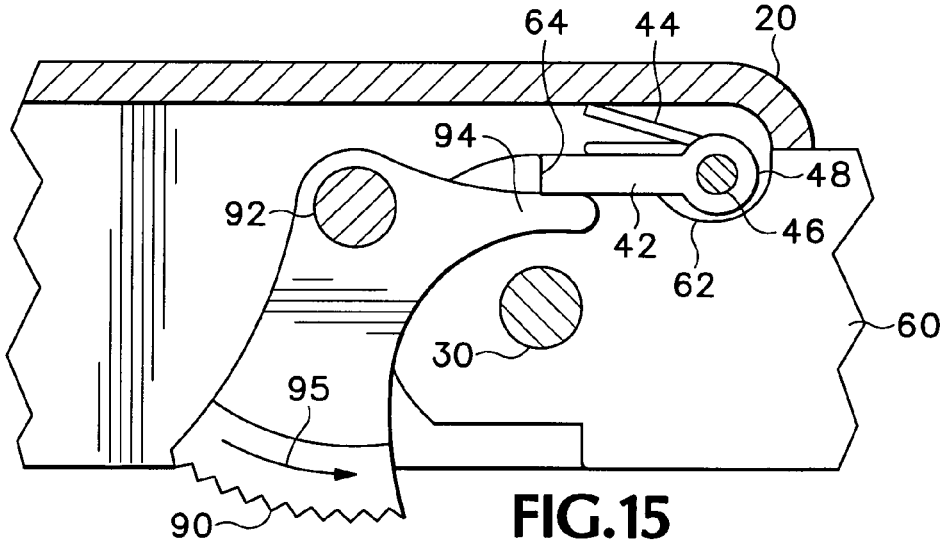
FIG. 15 is a partially cutaway elevational view of the part of the tool shown in FIG. 13, showing the blade lock in the engaged position.
Figure 16:
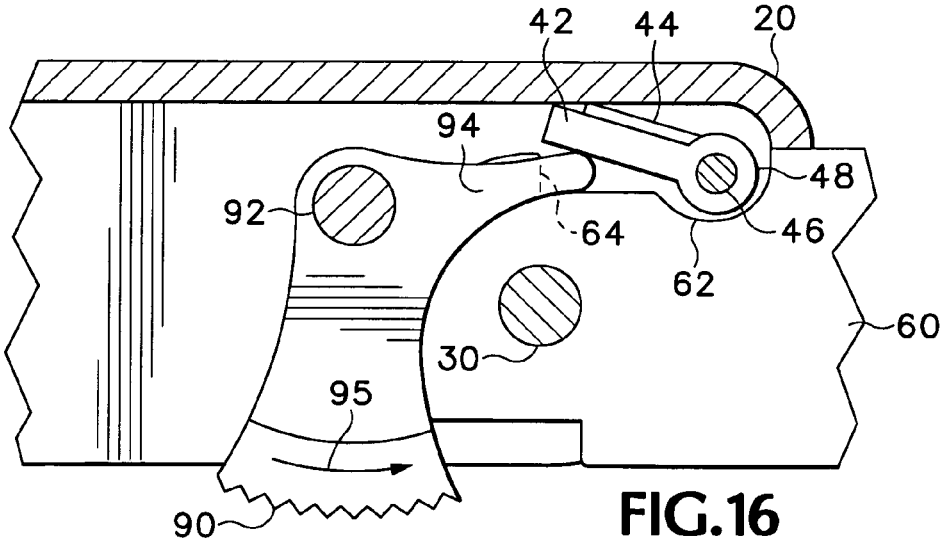
FIG. 16 is a partially cutaway elevational view of the part of the tool shown in FIG. 13, showing the blade lock in the disengaged position.
Figure 17:
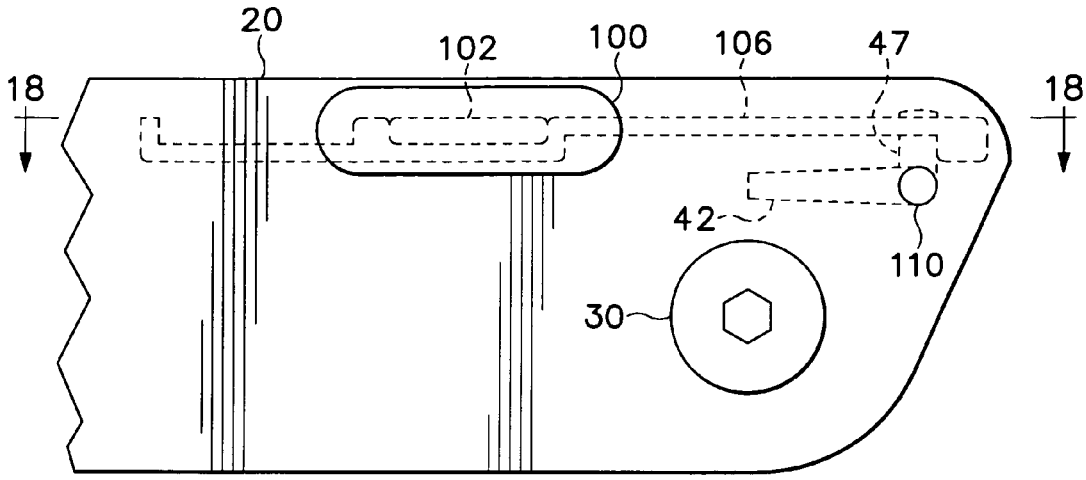
FIG. 17 is a side elevational view of a part of a multi-function tool including a blade lock that is another embodiment of one aspect of the present invention, including a sliding blade lock release mechanism.
Figure 18:
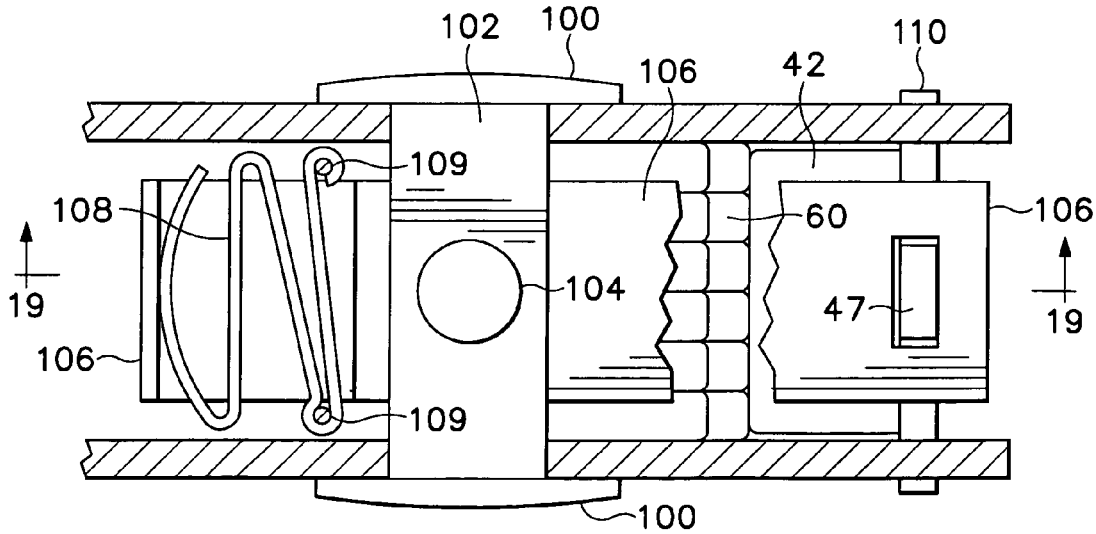
FIG. 18 is a sectional view taken along line 18-18 of FIG. 17, showing a spring and slider plate included in the blade lock release mechanism.
Figure 19:
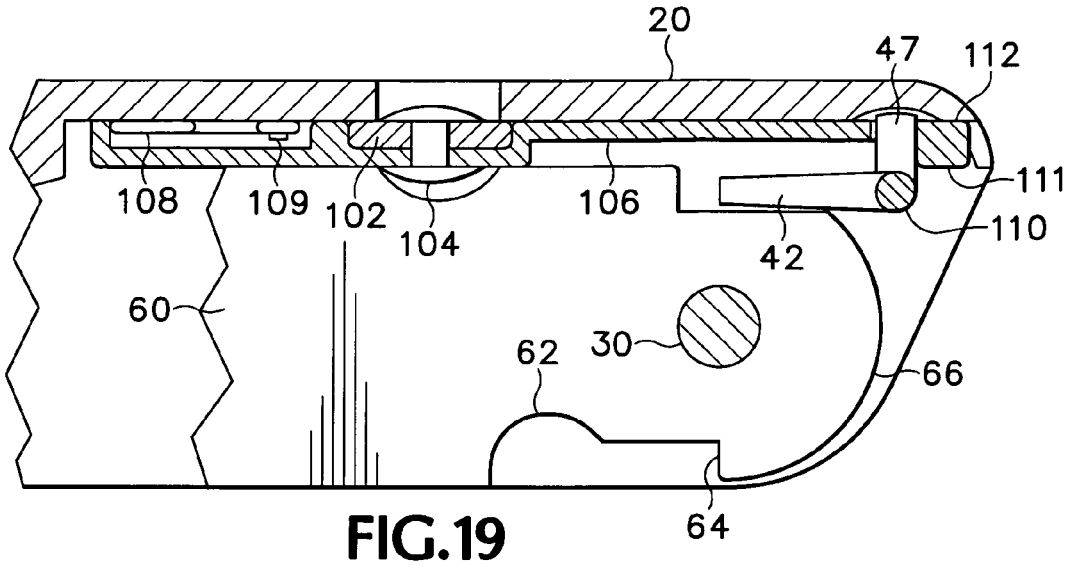
FIG. 19 is a sectional view of the part of a multi-function tool shown in FIG. 17, taken on line 19-19 of FIG. 18, and showing the blade lock in the engaged position.
Figure 20:
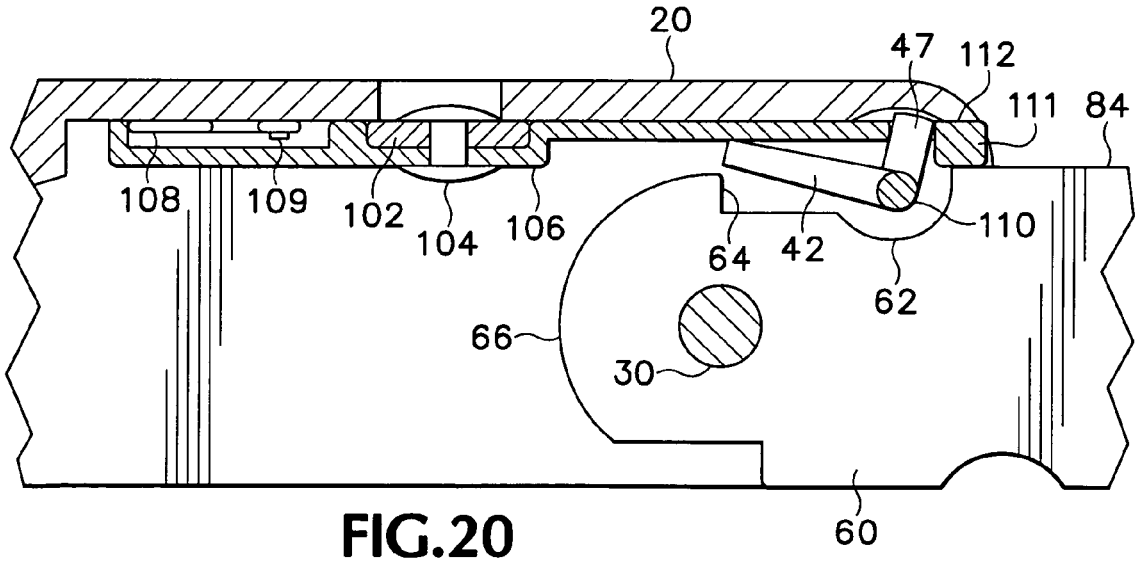
FIG. 20 is a partially cutaway elevational view of the part of the tool shown in FIG. 17, showing the blade lock in the disengaged position.

In yet another locking mechanism embodiment shown in FIGS. 13-16, a rocker release tab 90 is located within the cavity 61 of, and runs parallel to the side wall of the handle 20. Alternatively, as shown in FIG. 13A, the rocker release tab 90 can be located on the outside wall of the handle 20, with the rocker lever 94 interfacing with the locking body 42 by either the rocker lever 94 extending inward through a wall cavity to contact the locking body 42, or the locking body 42 extending through the wall cavity to contact the rocker lever 94 external to the cavity 61. In either case, the rocker release tab 90 is pivotal about rocker hinge 92 mounted in the side wall, and carries a rocker lever 94 that extends to contact the locking body 42. This embodiment as shown utilizes the torsion spring 44 to urge the locking body 42 toward the tang of blade 60, and either into the blade storage recess 65 of the blade 60 when the blade 60 is in the stowed position, or into engagement with the blade lock catch 64 when the blade 60 is in the extended position. The blade lock again utilizes lock sleeve 48 to rotate around blade lock pivot pin 46, which is again located distal to the fastener 30 at the distal end of the handle 20. Movement of the release tab 90 in the direction of the arrow 95 raises the locking body 42 out of engagement with the blade lock catch 64, overcoming the force of the torsion spring 44 to release the blade 60.

FIGS. 17-20 show yet another embodiment of the blade lock arrangement, wherein a slide release tab 100 is utilized to move the locking body 42. In this embodiment, a slide release tab 100 may be located on each side of the handle 20, and the two tabs are joined by slide cross brace 102. Slide cross brace 102 is in turn mechanically joined by a rivet 104, a spot weld, or other known means to slide frame 106. At the medial end of slide frame 106, a serpentine spring 108 is attached to the base of the handle 20 by spring pins 109. The distal end of slide frame 106 defines a hole in which a slide lever interface arm 47 is movably engaged. The slide lever interface arm 47 is in turn attached fixedly to the blade locking body 42, with the slide lever interface arm 47 being roughly perpendicular to the locking body 42. The blade locking body 42 and the lever interface arm 47 are carried on a lock pivot pin 110 mounted rotatably in the side walls of the handle 20 at a location distal of the fasteners 30 about which the blade 60 can rotate. As shown, the lever interface arm 47, the locking body 42, and the pin 110 are a unitary element, but it will be understood that the pin 110 could be separate, with a sleeve similar to the sleeve 48 carrying the locking body 42 and the interface arm 47 if ample space is provided. In this embodiment of the blade lock, when the slide release tabs 100 are moved toward the distal end of the handle 20, the slide lever interface arm 47 rotates the lock pivot pin 110, thereby moving the locking body 42 away from the tang of blade 60 so that the blade 60 may rotate about the fastener 30 to either a stowed or an extended position. The serpentine spring 108 is compressed as the slide release tabs 100 and slide cross brace 102 are moved toward the distal end of the handle 20 and then urges the slide cross brace 102 away from the distal end of the handle 20 when the slide release tabs 100 are released.

In the various locking mechanism embodiments presented, a torsion spring 44, a leaf spring 45, or a serpentine spring 108 has been shown and may be interchangeable within the various embodiments, the requirement solely being to urge the locking body 42 toward the tang of the blade 60. Other springs, such as a helical compression spring, may be utilized to achieve the same result and fall within the scope of this invention.

FIGS. 26-29 detail embodiments of the handles 20 of the folding multi-function tool 10. Each handle 20 contains two handle halves 19 and 21. Each handle half 19 and 21 defines a jaw lock recess 22 at its proximal end, and fastener holes 24 and 26 for receiving fasteners 30 at each end. The two handle halves 19 and 21 each contain a sidewall, a top portion and a bottom portion. One handle half 21 contains a male handle brace 28, and the other handle 19 contains a female handle brace 27, and the two braces intertwine to provide stability to the bottom portion of the handle 20, and to engage the base of the associated one of the jaws 70 to carry squeezing forces from the handle 20 to the jaw to urge the jaws to close toward each other to grip an object or in operation of scissors or shears. The male and female braces are kept together by appropriate tension in the fastener 30 at the proximal end of the handle. At the distal end of each handle 20 top portion of the handle half 21 overlaps a portion of handle half 19, as shown in section view of FIG. 27, and the overlapping portions are attached to each other by handle rivet 23 or other suitable mechanical means. Optionally, portions of each of handle halves 19 and 21 could overlap portions of the other handle half, with both overlapping sections being mechanically inter-connected by handle rivets 23 as shown in FIG. 29. A jaw-receiving opening 32 is defined in the top of the proximal end of each handle 20 to permit the jaws 70 to be folded into the storage cavity 61. By including structural support for the handles 20 on both the top and bottom portions, the handles 20 can be made to be more structurally sound and stable. The sidewalls of handle 20 may be straight-walled, or may be ergonomically designed as desired, and may have an appropriate coating or cover of a different material than that of the structural handle halves 19 and 21.

Figure 21:
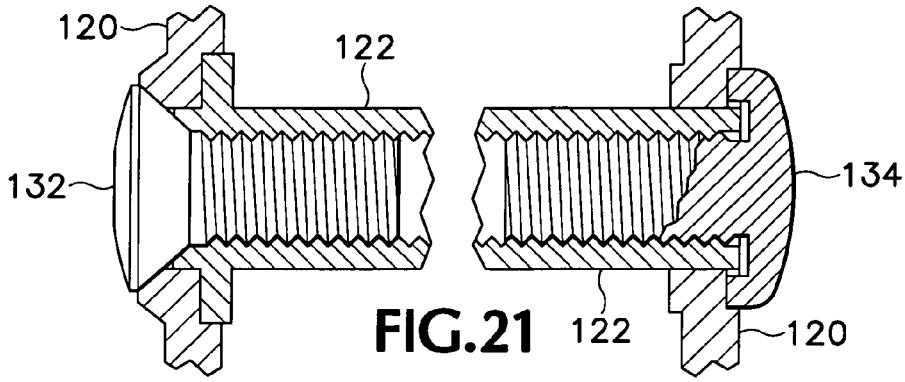
FIG. 21 is a side view of a shoulder stud and cap screw fastener system.
Figure 22:
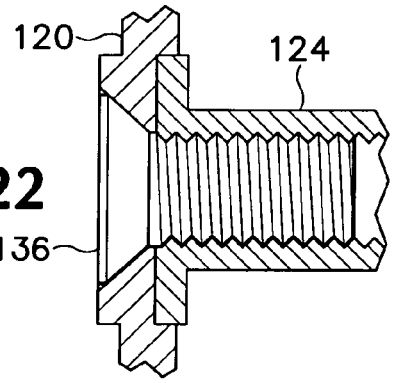
FIG. 22 is a side view of an alternate shoulder stud fastener system.
Figure 23:
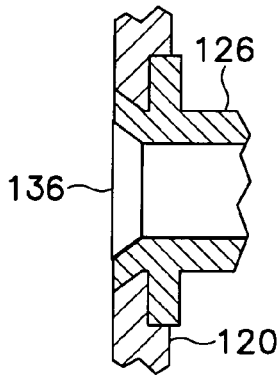
FIG. 23 is a side view of a peened shoulder stud fastening system.
Figure 24:
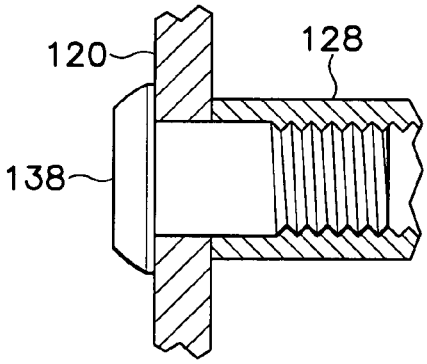
FIG. 24 is a side view of a modified screw and stud fastening system.

Details of the fasteners 30 are shown specifically in FIGS. 21-25. FIG. 21 shows an internally threaded peened stud 122 mating with side walls 120 and being attached by a raised countersunk head screw 132 at one end and a cap screw 134 at the other, which may be used as fastener 30. Alternative heads, such as a countersunk head 136 shown in FIGS. 22 and 23 may be used to provide a surface generally flush with side walls 120, with the respective studs 124 or 126 having flanges to interact with side walls 120. The exterior wall of the various studs 122, 124, 126, 128, or 130 acts as the pivot joints for the various blades 60 or jaw mounts 69. Utilization of the handle halves 19 and 21, combined with threaded fasteners 30 in any combination of the forms presented in FIGS. 21-25 allow for precise coaxial adjustment of the handles 20 on the jaws mounts 69 and the various blades 60.

Figure 25:
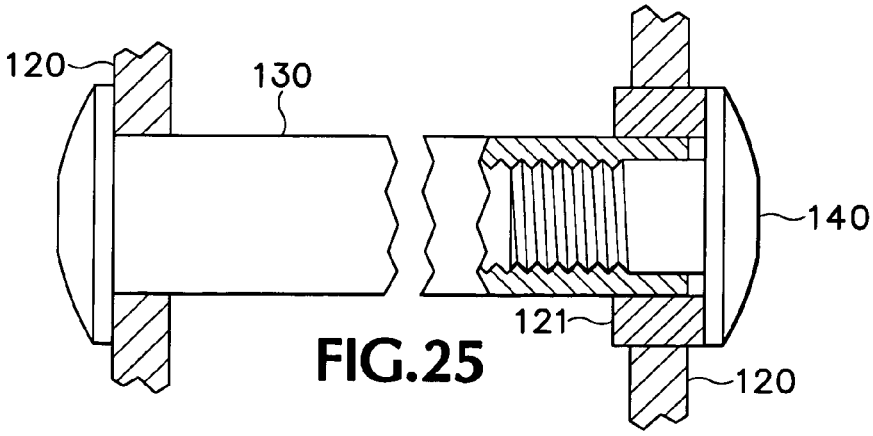
FIG. 25 is a side view of a screw stud fastening system.

FIG. 25 shows an alternative attachment method with an internally threaded button head stud 130 going through the side wall 120 and mating with a button head cap screw 140. A sliding sleeve 121 travels through the side wall 120 and bears against the stack of blades 60 to allow infinite adjustability in the case where the handle 20 is one solid piece instead of the two mating pieces shown in FIGS. 26-29. The infinite adjustability offered by tightening the button head cap screw 140 against the sliding sleeve 121, and consequently against the stack of blades 60 provides a significant amount of dimensional tolerance, thereby reducing manufacturing costs.

While the invention has been described in some embodiments, it should be readily apparent to those skilled in the art that many modifications, additions, and deletions may be made therein without departing from the spirit and scope of the invention. Various embodiments of the invention may be utilized alone, or in any combination. The invention is therefore not intended to be limited by the explicitly disclosed embodiments provided, but rather by the appended claims.

What is claimed is:

1. A multi-function tool, comprising:

a jaw-type tool having two jaws interconnected with each other by a jaw pivot joint, at least one of the jaws being pivotally connected to a handle by a handle pivot joint, and said handle having a pair of side walls, a top and a bottom, and a spring connected to one of said pair of side walls, said spring being biased to move laterally from the one of the pair of side walls towards an opposite one of the pair of side walls into engagement with a base of the one of the jaws to which the handle is connected when the one of the jaws is extended with respect to the handle, so as to prevent the one of the jaws from pivoting around the handle pivot joint in a jaw-collapsing direction and said handle comprising first and second handle halves, the handle halves being interconnected with each other by male and female handle braces included in the handle halves on one of the top and bottom and located adjacent said handle pivot joint, and the handle halves being interconnected with each other on the other of the top and bottom by said first handle half having a flange overlapping a portion of said second handle half located on said other one of said top and bottom, and by a mechanical fastener fastening the flange to the second handle half.

2. The multi-function tool of claim 1, wherein the handle defines a cavity capable of receiving a portion of the jaw-type tool for storage therein when the jaw to which it is connected is rotated around the handle pivot joint to a stowed position.

3. The multi-function tool of claim 1, wherein the mechanical fastener is a rivet.

4. The multi-function tool of claim 1, wherein the spring is a leaf spring.

5. The multi-function tool of claim 4, wherein the leaf spring is connected to the side wall of the handle, the leaf spring having an end that is movable away from the side wall and along an outer surface of the base of the at least one of the jaws.

6. The multi-function tool of claim 2, wherein the spring is biased to extend into the cavity.

7. The multi-function tool of claim 1, wherein the jaw-type tool is pliers.

8. A multi-function tool, comprising:

a jaw-type tool having two jaws interconnected with each other by a jaw pivot joint, at least one of the jaws being pivotally connected to a first end of a handle, said handle having a side wall and a jaw lock spring connected thereto, and said spring being capable of interacting with said at least one of the jaws to which the handle is connected to prevent said at least one of the jaws from pivoting around the handle, said handle having a second, distal end, a top, and a bottom, and said distal end, said top, said bottom, and said side wall defining a blade cavity;

a fastener passing through said blade cavity adjacent said second, distal end of said handle, the fastener acting as a pivot for at least one blade, and the blade being rotatable about the fastener into and out of the blade cavity; and a blade lock mechanism adjacent said second, distal end of said handle, the blade lock mechanism having a blade locking body capable of interacting with the at least one blade, and the blade locking body being pivotally moveable with respect to the handle about a pivot located in said handle between said fastener and said second, distal end.

9. The multi-function tool of claim 8, wherein the jaw lock spring is a leaf spring.

10. The multi-function tool of claim 9, wherein the side wall of the handle defines the leaf spring.

11. The multi-function tool of claim 8, wherein the jaw lock spring is biased to extend into the cavity.

12. The multi-function tool of claim 8, wherein a spring urges the blade locking body toward a tang end of the at least one blade.

13. The multi-function tool of claim 12, wherein said spring is a torsion spring.

14. The multi-function tool of claim 8, including at least one blade lock release that accesses the blade lock mechanism through the side wall of the handle.

15. The multi-function tool of claim 14, wherein the blade lock release includes a release tab mounted movably in the side wall.

16. The multi-function tool of claim 14, wherein the blade lock release includes a blade lock release arm that extends outward from said side wall.

17. The multi-function tool of claim 8, wherein said handle comprises first and second handle halves, the handle halves being interconnected with each other by male and female handle braces included in the handle halves on one of the top and bottom and located adjacent said first end of said handle, said handle halves being interconnected with each other on the other of the top and bottom by said first handle half having a flange overlapping a portion of said second handle half on said other one of said top and bottom, and by a mechanical fastener fastening the flange to the second handle half.

18. The multi-function tool of claim 17, wherein the mechanical fastener is a rivet.

* * * * *

UNITED STATES PATENT AND TRADEMARK OFFICE

CERTIFICATE OF CORRECTION

PATENT NO. : 7,921,752 B2
APPLICATION NO. : 12/077782
DATED : April 12, 2011
INVENTOR(S) : Paul W. Poehlmann It is certified that error appears in the above-identified patent and that said Letters Patent is hereby corrected as shown below:

Col. 5, line 34, "FIG. 27 is a sectional view taken along line 26 showing two handle halves riveted together." should read --FIG. 27 is a sectional view taken along line 27-27 of FIG. 26, showing two handle halves riveted together.--.

Col. 8, line 3, "the blade vertical wall" should read --the vertical wall--.

Signed and Sealed this
Sixteenth Day of October, 2012

David J. Kappos

David J. Kappos
*Director of the United States Patent and Trademark Office*